US009389039B2

(12) United States Patent
Denton et al.

(10) Patent No.: US 9,389,039 B2
(45) Date of Patent: Jul. 12, 2016

(54) ADJUSTABLE LIMB SYSTEMS FOR ARCHERY BOWS

(71) Applicant: Hoyt Archery, Inc., Salt Lake City, UT (US)

(72) Inventors: Douglas Edward Denton, Stansbury Park, UT (US); Donald Wasilewski, Stansbury Park, UT (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 0 days.

(21) Appl. No.: 14/498,926

(22) Filed: Sep. 26, 2014

(65) Prior Publication Data

US 2016/0091273 A1 Mar. 31, 2016

(51) Int. Cl.
*F41B 5/00* (2006.01)
*F41B 5/14* (2006.01)
*F41B 5/10* (2006.01)

(52) U.S. Cl.
CPC ..... *F41B 5/0052* (2013.01); *F41B 5/00* (2013.01); *F41B 5/10* (2013.01); *F41B 5/14* (2013.01)

(58) Field of Classification Search
CPC ..... F41B 5/10; F41B 5/0026; F41B 5/14
USPC ..... 124/23.1, 25.6, 86, 88
See application file for complete search history.

(56) References Cited

U.S. PATENT DOCUMENTS 3,957,027 A * 5/1976 Drake ..... F41B 5/0026 124/23.1
4,494,521 A * 1/1985 Quartino ..... F41B 5/10 124/23.1
4,793,319 A * 12/1988 Vaughan ..... F41B 5/0026 124/25.6
5,231,970 A * 8/1993 Ploot ..... F41B 5/10 124/23.1
5,280,779 A * 1/1994 Smith ..... F41B 5/0026 124/23.1
5,411,008 A * 5/1995 Hsu ..... F41B 5/14 124/23.1
5,433,792 A * 7/1995 Darlington ..... F41B 5/10 124/23.1
5,464,001 A * 11/1995 Peck ..... F41B 5/10 124/23.1
5,487,373 A * 1/1996 Smith ..... F41B 5/10 124/23.1

(Continued)

*Primary Examiner* — Alexander Niconovich
(74) *Attorney, Agent, or Firm* — Holland & Hart

(57) ABSTRACT

Systems, apparatus, and methods for adjusting limb placement in an archery bow are provided. The limb may be adjusted laterally and may be rotated around its length to manipulate the position of the distal end of the limb with respect to the riser. The limb may be rotated by posts extending from the limb or limb bolt. The limb may also be rotated by posts or shims positioned in an adjustable dowel installed in the riser or by shims installed in the limb between the limb and the riser.

29 Claims, 18 Drawing Sheets

(56) References Cited

U.S. PATENT DOCUMENTS 5,515,836 A * 5/1996 Martin ..... F41B 5/0026 124/23.1
5,660,158 A * 8/1997 Rudolph ..... F41B 5/0026 124/23.1
5,720,267 A * 2/1998 Walk ..... F41B 5/10 124/23.1
5,762,060 A * 6/1998 Larson ..... F41B 5/1426 124/23.1
6,024,076 A * 2/2000 Laborde ..... F41B 5/0026 124/23.1
6,244,259 B1 * 6/2001 Adkins ..... F41B 5/0026 124/23.1
6,571,785 B1 * 6/2003 Choma ..... F41B 5/123 124/23.1
6,712,057 B2 * 3/2004 Andrews ..... F41B 5/0026 124/23.1
7,047,958 B1 * 5/2006 Colley ..... F41B 5/105 124/25.6
7,077,116 B1 * 7/2006 Darlington ..... F41B 5/10 124/23.1
7,308,890 B1 * 12/2007 Wheeler ..... F41B 5/10 124/23.1
7,334,575 B2 * 2/2008 McPherson ..... F41B 5/0026 124/23.1
7,762,245 B2 * 7/2010 Smith ..... F41B 5/10 124/23.1
7,784,452 B1 * 8/2010 Kronengold ..... F41B 5/10 124/23.1
7,832,387 B1 * 11/2010 Yehle ..... F41B 5/0094 124/23.1
7,832,388 B1 * 11/2010 Kronengold ..... F41B 5/10 124/25.6
7,918,218 B1 * 4/2011 Kronengold ..... F41B 5/10 124/23.1
7,980,236 B1 * 7/2011 Kronengold ..... F41B 5/10 124/23.1
8,047,189 B2 * 11/2011 McPherson ..... F41B 5/10 124/23.1
8,281,773 B2 * 10/2012 Dahl, II ..... F41B 5/10 124/23.1
8,347,869 B2 * 1/2013 Sims ..... F41B 5/10 124/23.1
8,408,192 B2 * 4/2013 McPherson ..... F41B 5/10 124/23.1
8,459,244 B2 * 6/2013 Yehle ..... F41B 5/0094 124/23.1
8,776,770 B2 * 7/2014 Batdorf ..... F41B 5/10 124/23.1
8,844,508 B2 * 9/2014 Sims ..... F41B 5/10 124/25
9,010,307 B2 * 4/2015 Jolley ..... F41B 5/0026 124/23.1
9,103,622 B2 * 8/2015 Park ..... F41B 5/0026
2012/0192843 A1 * 8/2012 Batdorf ..... F41B 5/10 124/25.6

* cited by examiner

ADJUSTABLE LIMB SYSTEMS FOR ARCHERY BOWS

TECHNICAL FIELD

The present disclosure generally relates to apparatus and methods for tuning an archery bow by adjusting the position of limbs of the bow and relates specifically to apparatus and methods for non-permanently adjusting a tilt angle of a limb relative to a riser.

BACKGROUND

In archery bows, customization and adjustability are highly prized features. Skilled archers take advantage of even small adjustments to the weight, size, and position of various elements of the bow to improve their accuracy and precision. One part of the bow that is greatly affected by fine adjustments is the bow's limbs. The limbs are the flexible members that are usually attached to the upper and lower ends of the handle riser of the bow in limb pockets. The limbs are usually secured to the bow by bolts such as dovetail bolts and tiller bolts.

A tiller bolt extends through an opening in the proximal end of the limb to retain the limb in the limb pocket. When a tiller bolt is adjusted, the limb moves forward or backward relative to the riser. A bow's "tiller" is defined as the difference in the perpendicular distance from the upper limb to the string and the lower limb to the string, as measured at the base of the limbs where they attach to the riser. Controlling the tiller may allow the archer to more easily and comfortably aim during the draw and release of the shot. The tiller also affects the angle at which the arrow is launched from the bow when the arrow is released.

Dovetail bolts extend toward the riser from the proximal end of the limb to mate with dovetail openings in the end structure of the limb pocket and/or a dowel that is attached to the riser. The dovetail bolt is used to keep the limb from falling out of the limb pocket and, in bows using dowels, to fix the limb's position relative to the dowel's main cylinder. In bows with dowels, the lateral position of the limb may be adjusted to the left and right relative to the riser by adjusting the dowel. When adjusted, the main cylinder of the dowel moves left and right within the riser, thus causing the dovetail bolt and the limb to which it is connected to move left and right as well. The limb's motion may be lateral translation or may be a rotation of the vertical axis of the limb to the left or right, depending on whether the limb is pivotally connected proximal to the dowel in the limb pocket. By adjusting the lateral position of the limb, the bowstring may be moved left and right at the distal end of the limb, so the archer may adjust the alignment of the bowstring relative to the riser and the arrow plane.

Conventional methods of adjusting the position of the limb relative to a riser only control the left-right lateral position of the limb or the front-back lateral position of the limb. This limits the amount of control the archer has over the tuning of his or her bow limbs. Therefore, there exists a need for improvements in archery bow limb tuning, particularly in positioning a riser relative to a limb.

SUMMARY

According to one aspect of the present disclosure, an archery bow assembly having adjustable limb placement is provided. The bow assembly may comprise a riser having a limb attachment portion and a limb that has a distal end extending away from the riser and a proximal end retained at the limb attachment portion of the riser. The limb may have a riser-facing surface and an outer surface. The bow assembly may also include an anchor retaining the proximal end of the limb in the limb attachment portion, the anchor having a limb-facing surface and at least one adjustable separator configured to spread apart the limb-facing surface of the anchor and the outer surface of the limb.

In the archery bow assembly, the proximal end of the limb may be a limb pivot surface and the anchor may be a weight-tiller adjustment bolt. A weight-tiller adjustment bolt may be referred to as a limb bolt configured to adjust the weight and/or tiller of the limb. Thus, the anchor may be a limb bolt, and the outer surface of the limb may comprise an adjacent surface positioned adjacent to the limb bolt, wherein the adjustable separator separates the adjacent surface from the limb-facing surface of the anchor. The adjacent surface may, for example, be lateral to the limb bolt on an outward-facing surface of the limb.

The adjustable separator may be adjustably retained in the limb, and it may spread apart the limb-facing surface of the anchor and the outer surface of the limb by adjustably extending from the outer surface of the limb. The adjustable separator may be adjustably retained in the anchor, and it may spread apart the limb-facing surface of the anchor and the outer surface of the limb by adjustably extending from the limb-facing surface of the anchor. The adjustable separator may be adjustable by driving a threaded surface of the adjustable separator.

The limb may comprise a central longitudinal axis, wherein the at least one adjustable separator separates the anchor and the limb along an axis perpendicular to the central longitudinal axis of the limb.

In some embodiments, the at least one adjustable separator may comprise at least two adjustable separators, wherein each of the at least two adjustable separators are positioned on opposing sides of the anchor. The at least one adjustable separator may comprise a shim removably attachable between the limb-facing surface of the anchor and the outer surface of the limb. A shim may be retained by a shaft, such as a shaft of a fastener.

The at least one adjustable separator may also be partially insertable into at least one opening in the outer surface or riser-facing surface of the limb.

In another aspect of the present disclosure, a method of adjusting the position of a limb of an archery bow is set forth. This method may comprise providing an archery bow assembly which includes: a riser having a limb attachment portion, a limb having a distal end extending away from the riser and a proximal end retained at the limb attachment portion of the riser, the limb having a riser-facing surface and an outer surface, an anchor retaining the proximal end of the limb in the limb attachment portion, the anchor having a limb-facing surface, and at least one adjustable separator configured to spread apart the limb-facing surface of the anchor and the outer surface of the limb. The method may further comprise adjusting an angle between the limb-facing surface of the anchor and the outer surface of the limb by adjusting the at least one adjustable separator to at least partially separate the limb-facing surface from the outer surface. The angle may be adjusted continuously or incrementally.

In another embodiment, an archery bow assembly having adjustable limb placement is provided. The bow assembly may include a riser having a limb attachment portion, wherein the limb attachment portion may have a limb-facing surface. The assembly may also have a limb having a distal end extending away from the riser and a proximal end retained at the limb attachment portion of the riser. This limb may have a riser-facing surface and an outer surface. A dovetail bolt may also be included that at least partially extends through the limb-facing surface of the limb attachment portion and the riser-facing surface of the limb, with the dovetail bolt retaining the limb to the riser. The assembly may further include at least one adjustable separator positioned lateral to the dovetail bolt between the limb-facing surface of the limb attachment portion and the riser-facing surface of the limb, the at least one adjustable separator being configured to spread apart the limb-facing surface of the limb attachment portion and the riser-facing surface of the limb. In these assemblies, the adjustable separator may comprise a threaded bolt. The adjustable separator may also comprise a removable shim.

In another embodiment, an archery bow assembly having adjustable limb placement is provided which may comprise a riser having a limb attachment portion. The limb attachment portion may have a limb-facing surface. The bow assembly may also include a limb having a distal end extending away from the riser and a proximal end retained at the limb attachment portion of the riser by an anchor, wherein the limb may have a riser-facing surface and an outer surface. In the bow assembly, a dowel may be positioned between the limb-facing surface of the limb attachment portion and the riser-facing surface of the limb, the dowel being positioned between the anchor and the distal end of the limb and the dowel comprising a limb-facing surface and at least one adjustable separator extending from the limb-facing surface. Herein, the adjustable separator may contact the riser-facing surface of the limb, wherein the adjustable separator may be configured to adjustably separate the limb-facing surface of the limb attachment portion from the riser-facing surface of the limb.

In the archery bow assembly, the adjustable separator may comprise a threading, wherein turning the adjustable separator drives the threading to extend or retract the adjustable separator from the limb-facing surface of the dowel.

In another configuration, the adjustable separator may comprise at least one shim positioned between the limb-facing surface of the dowel and the riser-facing surface of the limb. This shim may be removably attached to the dowel. The adjustable separator may also further comprise at least one cover plate positioned between the shim and the riser-facing surface of the limb. In some cases, the cover plate may have a curved surface facing the limb.

The adjustable separator may be removably attached to the dowel. The dowel may comprise at least two adjustable separators each being configured to contact the riser-facing surface of the limb.

In yet another embodiment, an adjustable dowel for an archery bow is provided, wherein the dowel may comprise a body portion having a first end and a second end, the body portion having a limb-facing surface and a riser-facing surface extending between the first end and the second end, wherein the body portion is configured to be laterally movable upon attachment to a bow riser. The dowel may also include an adjustable separator positioned on the limb-facing surface of the body portion, the adjustable separator extending from the limb-facing surface to a height, the adjustable separator being configured to change the height upon adjustment.

The height of the adjustable separator may be continuously adjustable, such as by the adjustable separator comprising a threaded post that may be adjustable by turning the threaded post relative to the body portion, thereby changing the height of the adjustable separator. The adjustable dowel may also comprise at least one set screw, the set screw preventing adjustment of the height upon tightening of the set screw against the threaded post.

In some arrangements the height of the adjustable separator may be incrementally adjustable, and the adjustable separator may comprise at least one shim removably attached to the limb-facing surface of the body portion.

In yet another aspect of the disclosure, a method of tuning an archery bow limb is provided, wherein the method comprises providing an archery bow comprising: a riser having a limb retaining portion, the limb retaining portion having a limb-facing surface, and a limb retained in the limb retaining portion of the riser, the limb having a riser-facing surface. The limb-facing surface may have a separator extending to a separation distance from the limb-facing surface toward the riser-facing surface of the limb. The method may further comprise adjusting the straightness of the limb relative to the riser by altering the separation distance of the separator.

The straightness of the limb may be adjustable relative to the riser while the limb is retained by the riser. Altering the separation distance may comprise inserting a removable shim between the separator and the limb-facing surface. The separator may comprise a threading, and altering the separation distance may comprise turning the separator.

The separation distance of the separator may be altered incrementally or continuously, and the straightness of the limb may be adjusted by tilting the limb-facing surface relative to the riser-facing surface.

In some embodiments, the limb-facing surface may be positioned on a dowel positioned between the limb retaining portion and the riser-facing surface of the limb. Thus, the dowel may be considered a component of the riser.

The above summary of the present invention is not intended to describe each embodiment or every implementation of the present invention. The Figures and the detailed description that follow more particularly exemplify a preferred embodiment.

DETAILED DESCRIPTION

Figure 1:
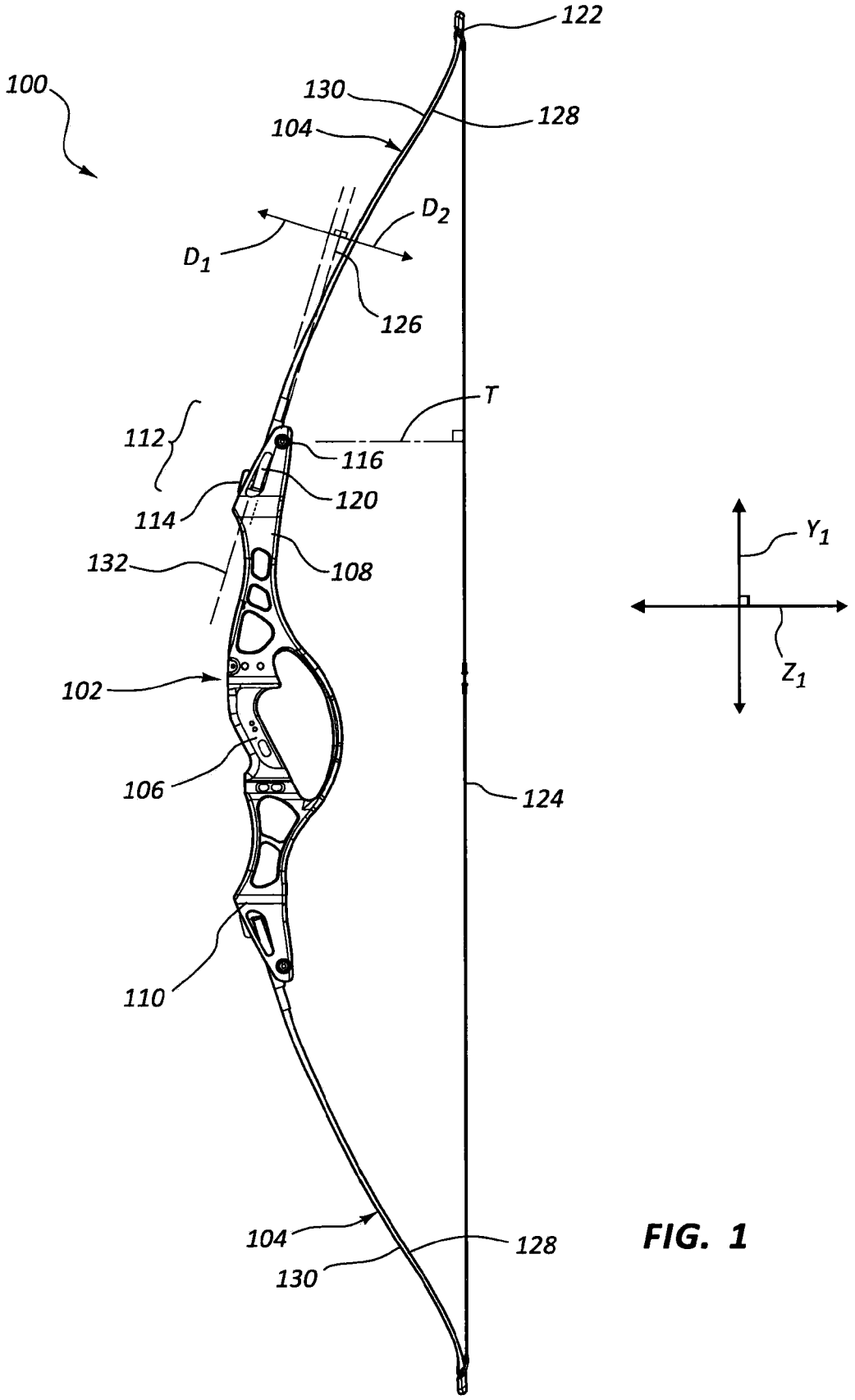
FIG. 1 is a side view of an archery bow having a limb bolt head having adjustable posts.

The present disclosure generally relates to systems, apparatuses, and methods that allow a user to pivot, turn, or rock a bow limb, such as a recurve bow limb, relative to a riser. This may allow the distal tip of the limb to be tuned so that it is pulled in a straight line throughout a draw cycle. This may improve the comfort, accuracy, and precision of a bow by giving archers more customization and control over the forces acting on an arrow.

In one aspect of the disclosure, a bow may have a riser configured to receive and retain a limb. The limb may be secured to the riser at a proximal end of the limb by a limb bolt and/or dovetail bolt, and a distal end of the limb may extend away from the riser. The limb bolt may be referred to as an anchor. An anchor may also be a post, bolt, clamp, or another device used to keep the limb attached to the riser. In some embodiments, the limb is permanently attached to the riser at its proximal end. The riser and limb may be part of a bow, such as, for example, a recurve bow, traditional bow, or compound bow. The riser may comprise a limb attachment portion, such as, for example, a limb pocket configured to receive the proximal end of the limb. The limb pocket may have a surface facing the limb (i.e., a limb-facing surface), and the limb may have a surface facing the riser (i.e., a riser-facing surface).

In one embodiment, the limb may comprise openings or apertures in the riser-facing surface of the limb at a portion of the riser-facing surface that contacts the riser or a dowel positioned in the limb pocket. For example, the portion of the riser-facing surface may be laterally adjacent to (i.e., to the left or right of) the dovetail bolt. This area may also be defined as being lateral from a longitudinal axis running along the limb. The openings may be configured to receive one or more removably attachable shims. The shims may separate the limb-facing surface of the riser from the riser-facing surface of the limb. By inserting an uneven number or size of shims into the openings on each side of a dovetail bolt or on opposite sides of the riser-facing surface and then seating the limb in the limb pocket, the limb may be turned to an angle around the limb's longitudinal axis, which angle is provided by the offset of the shims. Thus, the distal tip of the limb may be pivoted and turned relative to the riser, causing the bowstring to also be repositioned relative to the riser. In some cases, the shims may be used to evenly space apart the limb-facing surface and riser-facing surface on each side of the limb's longitudinal axis. This may allow the archer to adjust the tiller of the bow by moving the limb forward relative to the riser.

In another example embodiment, the limb may comprise adjustable posts positioned at its proximal end that are adjacent to a limb bolt extending through the limb. The posts may separate the outer or frontal surface (i.e., a bolt-head-facing surface) of the limb from a limb-facing surface of the limb bolt. The posts may be positioned laterally from the longitudinal axis of the limb. Thus, when the posts are adjusted to extend from the outer surface of the limb or to retract into the outer surface of the limb, the limb-facing surface of the bolt and the outer surface of the limb may be separated to a desired angle, thereby pivoting the limb around its longitudinal axis. In another embodiment, the posts may be mounted in the head of the bolt and extend toward the outer surface of the limb. These posts may also have their height adjusted relative to the limb-facing surface of the bolt to change the angle between the limb-facing surface of the bolt and the outer surface of the limb.

In yet another example, the angle of the limb relative to the riser may be adjusted by adjusting a post or shim portion of a limb dowel. For instance, the dowel may have an adjustable post that extends between the riser-facing surface of the limb and the limb-facing surface of the dowel. As the post is adjusted, the limb may rotate relative to the riser around the limb's longitudinal axis due to contact with the post. In some embodiments, additional posts may be used, such as one post on each side of the longitudinal axis, so that the tiller of the bow may be changed by increasing the distance between the dowel and the limb on each side of the longitudinal axis and so that the angle of the limb may be adjusted in either direction around its longitudinal axis. Similarly, the dowel may have a portion configured to retain shims that fit between the dowel and the limb. These shims may also space the limb from the riser to adjust the tiller of the bow.

The present disclosure sets forth a detailed description of specific embodiments of the invention, but it will be understood that various combinations of elements of the individual embodiments may be made to obtain related embodiments. The disclosure is therefore not meant to define every embodiment, but is to provide illustrative examples of how certain embodiments operate while incorporating related embodiments in the spirit and scope of a more general disclosure. For example, a limb angle may be adjustable by posts extending from a limb bolt and also by shims attached to the limb adjacent to a dovetail bolt. Other such embodiments will be apparent to those having skill in the art and the benefit of the present disclosure.

Turning now to the figures in detail, FIG. 1 shows a side view of a bow 100 according to an embodiment of the present disclosure. The bow 100 may include a handle riser 102 with a limb 104 attached to it. The riser 102 may have a handgrip portion 106 generally centrally located between an upper end 108 and a lower end 110 of the riser.

The limb 104 may be retained in a limb pocket 112 of the riser 102 by a limb bolt 114 and a dowel 116 having a dovetail bolt 118 (see FIG. 2) extending through the limb 104. The limb 104 may have a proximal end 120 and a distal end 122. The proximal end 120 may be retained in the limb pocket 112, and the distal end 122 may extend away from the riser 102 and link to a bowstring 124 that is attached to the distal end of a lower limb of the bow. The limb 104 shown in FIG. 1 is a recurve limb, but other types of limbs (e.g., compound bow limbs or traditional bow limbs) may be used.

The limb 104 may form a riser contact plane 126 along the riser-facing side 128 of the limb 104. The riser-facing side 128 may also be referred to as the rear surface or pocket-facing surface of the limb 104. The outward-facing side 130 of the limb 104 forms a bolt contact plane 132 where the outward-facing side 130 contacts the underside of the head of the limb bolt 114. See also FIG. 3. Adjustment of the limb angle using embodiments disclosed herein may cause the limb 104 to rotate while its longitudinal axis (e.g., axis L in FIG. 2) remains in the riser contact plane 126 and/or bolt contact plane 132.

The tiller measurement of the limb 104 may be measured perpendicular to the bowstring where the limb 104 contacts the riser 102, as shown by tiller distance T in FIG. 1. Adjusting the tiller distance of the upper limb 104 may increase or decrease the tiller distance T by rotating the riser contact plane 126 and moving the bowstring 124 away or toward the contact point of the limb 104 and the riser 102. In some embodiments, the tiller distance may change in the $D_1$ direction or the $D_2$ direction (which directions are defined perpendicular to the riser contact plane 126). Similarly, a $D_1$ and $D_2$ direction may be defined perpendicular to the bolt contact plane 132 instead.

Figure 2:
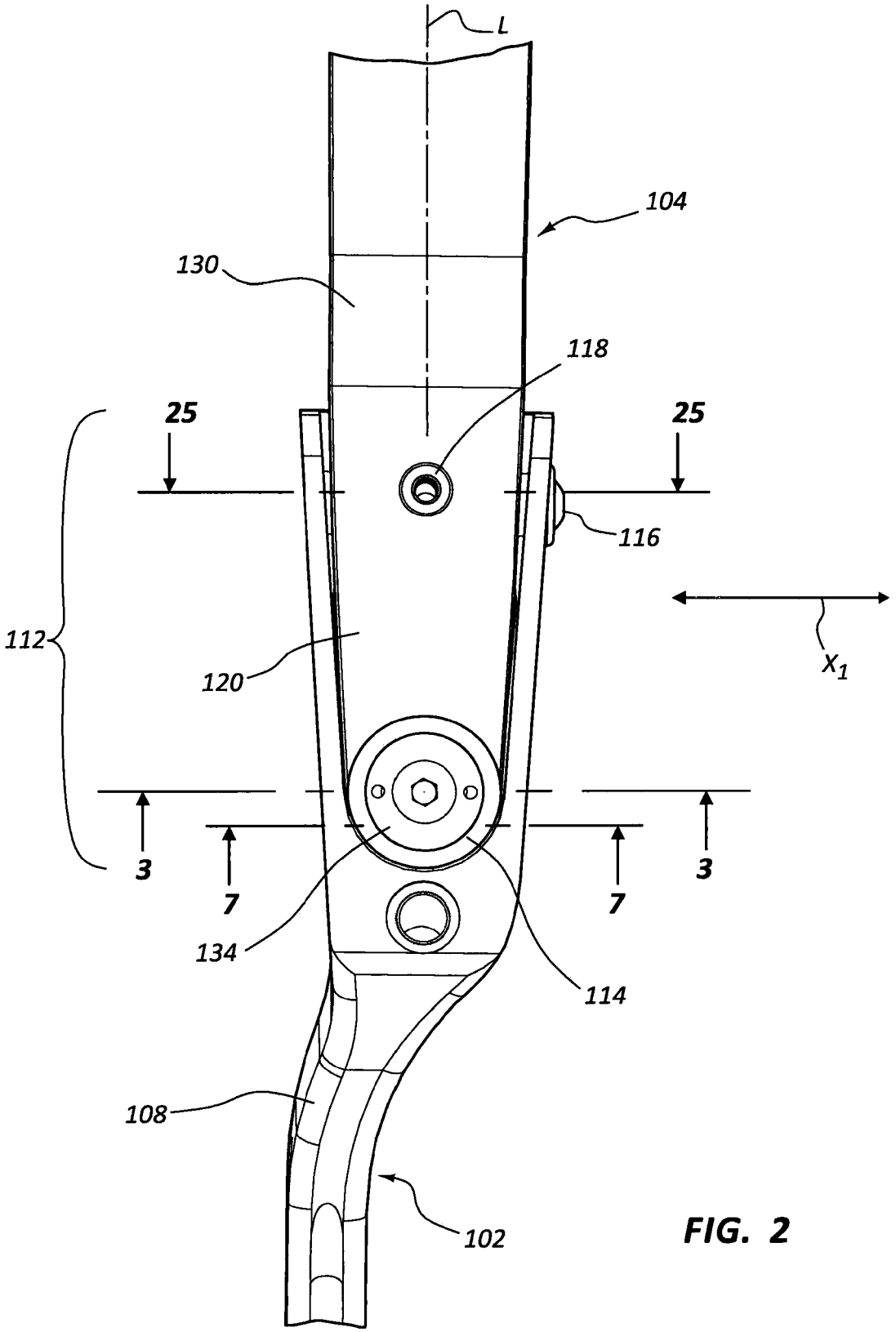
FIG. 2 is a front detail view of a limb pocket portion of the archery bow of FIG. 1.

FIG. 2 shows a detail view of the outward-facing side 130 of the proximal end 120 of the limb 104. The proximal end 120 is inserted into a limb pocket 112. The dovetail bolt 118 is shown that extends through the limb 104 and into the dowel 116. The head 134 of the limb bolt 114 is also shown proximal to the dovetail bolt 118. A longitudinal axis L of the limb 104 is shown that extends through the centerline of the limb 104.

Figure 3:
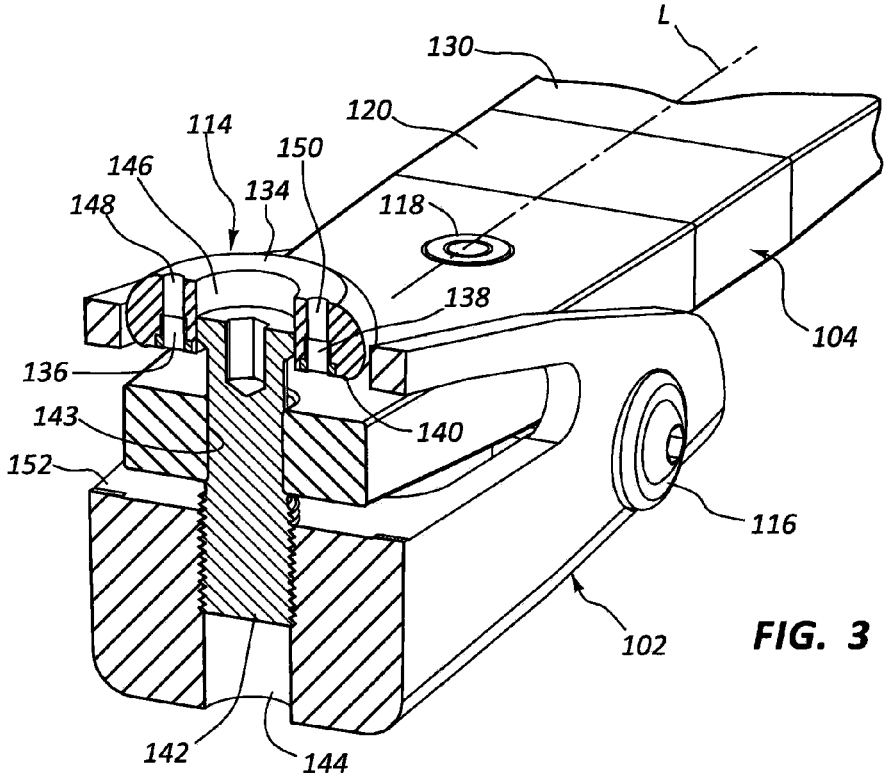
FIG. 3 is a section view of the archery bow of FIG. 2 taken through section lines 3-3.
Figure 4:
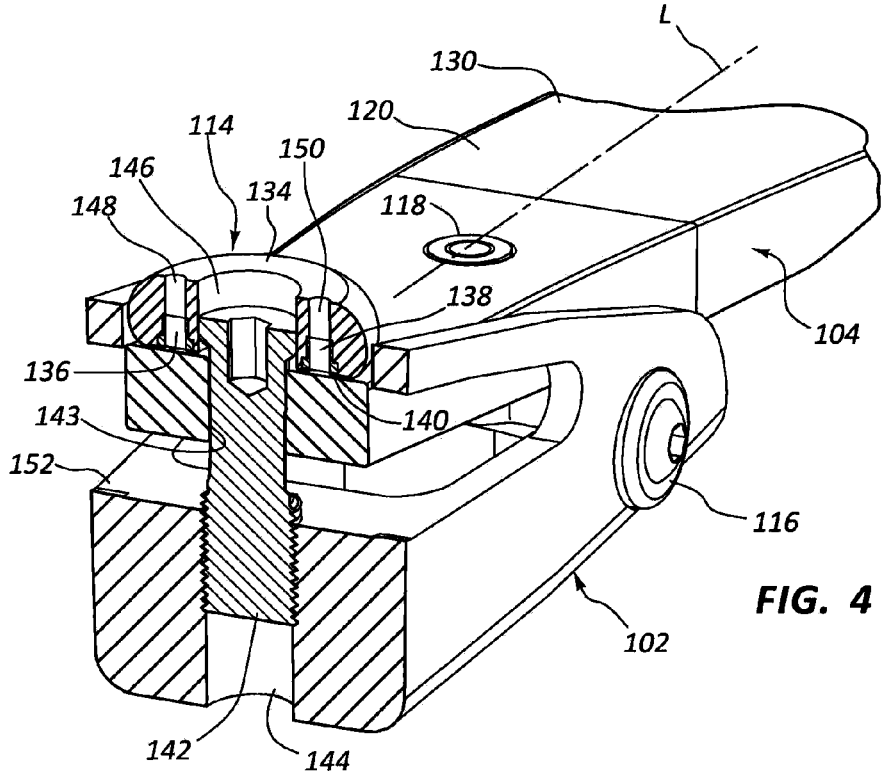
FIG. 4 is a section view of the archery bow of FIG. 3 with the limb in tension.
Figure 5:
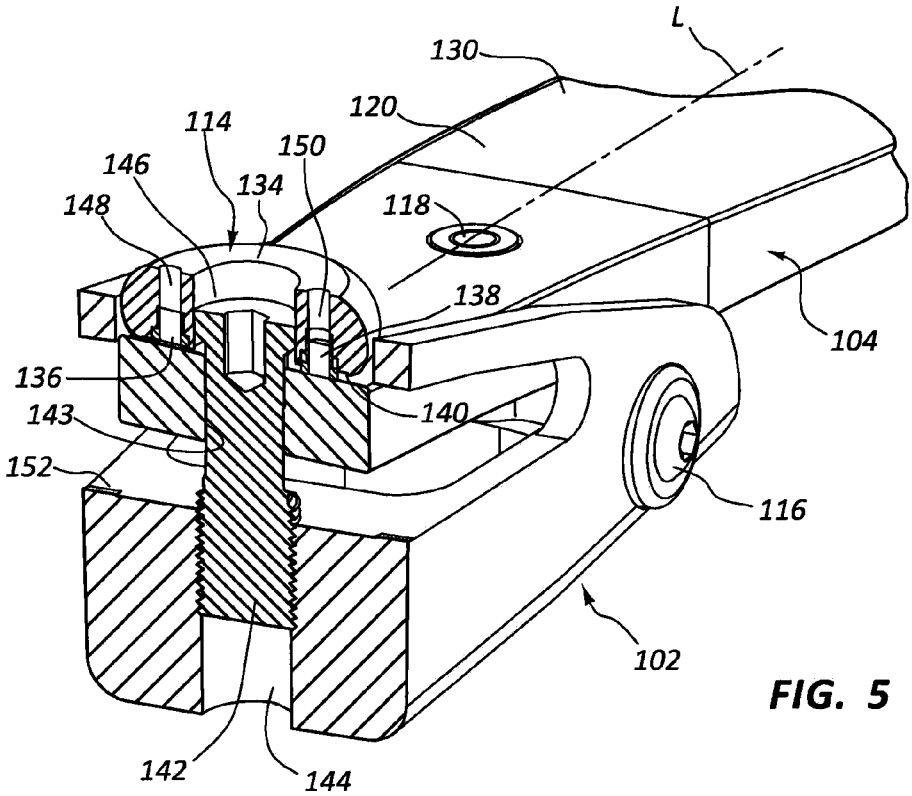
FIG. 5 is a section view of the archery bow of FIG. 3 with the limb in tension and rotated by adjustable posts.

FIGS. 3-5 are section views taken through section lines 3-3 in FIG. 2. These views show detail of the operation of adjustable posts 136, 138 installed in the head 134 of the limb bolt 114. The posts 136, 138 may extend downward from a limb-facing surface 140 of the head 134 of the limb bolt 114 toward the outward-facing side 130 of the limb 104. The limb bolt 114 may have a shaft 142 extending through a limb opening 143 and retained in a bolt aperture 144 within the riser 102. The head 134 of the limb bolt 114 may comprise a shaft adjustment opening 146 and a plurality of post adjustment openings 148, 150. Through the shaft adjustment opening 146, the bolt 114 may be rotated and adjusted relative to the riser 102, and through the post adjustment openings 148, 150, the posts 136, 138 may individually have their positions in the bolt head 134 adjusted. In some embodiments, the posts 136, 138 may be adjusted by accessing them from the surface 140 of the bolt head 142 that they extend from. In that case, the limb 104 or limb bolt 114 may need to be removed to access the posts 136, 138. In some embodiments, the posts 136, 138 may be adjusted to translate relative to the limb-facing surface 140 of the bolt head 134 through the side of the bolt head 134.

The posts 136, 138 may be retained in the bolt head 134 by a non-permanent or semi-permanent attachment mechanism, such as a threading (see FIGS. 9A-9C), a press-fit, interference fit, snap-fit, or other similar reversible or removable attachment means. In some other embodiments, the posts 136, 138 may be permanently attached in a predetermined position relative to the bolt head 134. The positions of the posts 136, 138 may be defined as being lateral in the bolt head 134 relative to longitudinal axis L of the limb 104. For example, the posts 136, 138 may be positioned in the bolt head 134 along an axis perpendicular to the longitudinal axis L of the limb 104. Alternatively, the posts 136, 138 may be defined as being lateral to the limb opening 143, lateral to the shaft 142 of the bolt 114, laterally along an axis running through the dowel 116 (or along an axis parallel thereto), or laterally relative to the riser 102 or bowstring 124.

The limb bolt 114 may have single-piece, unitary construction, or may have a bolt head 134 that is attachable or removably attachable to the shaft 142 of the bolt 114. If the bolt head 134 is a separate part of the bolt 114, the head 134 may be pivotable or rotatable relative to the shaft 142.

The limb opening 143 may be defined as an aperture through the limb 104 through which the bolt 114 extends. The limb opening 143 may be a hole through the limb, a slot in the proximal end 120 of the limb 104, or another comparable space through which the bolt 114 may fit. In some embodiments, the proximal end 120 of the limb 104 may flex laterally and/or longitudinally in order to open and receive the shaft 142 of the limb bolt 114 when the limb 104 is installed in the pocket 112. In the embodiments pictured, a slot is formed at the end of the limb 104 within which the limb bolt 114 is seated when the limb 104 is completely inserted into the pocket 112.

In FIG. 3, the posts 136, 138 are retracted to be within or flush with the limb-facing surface 140 of the bolt head 134. The outward-facing side 130 of the limb 104 may not be in contact with the limb-facing surface 140. In some embodiments, the limb 104 may comprise only one post 136 or 138. In these embodiments, the tilt of the limb 104 may only be adjustable by one post 136 or 138 rather than by both posts 136, 138.

As shown in FIG. 4, the limb 104 may be subject to tension (e.g., when the bow is drawn) and the outward-facing side 130 of the limb 104 may contact the limb-facing surface 140 of the bolt head 134. The limb 104 may bend into contact with the bolt head 134 because of the tension in the bowstring 124 on the distal end 122 of the limb 104 pulling the distal end 122 rearward and the contact between the limb 104 and the dowel 116 producing a resultant force against the direction of the bowstring tension. If the posts 136, 138 are not fully retracted into the bolt head 134 when the bow is drawn, the outward-facing side 130 of the limb 104 may not come into contact with the limb-facing surface 140 of the bolt head 134, thereby causing the outward-facing side 130 to rest when it comes into contact with the posts 136, 138. In this situation, the limb 104 does not pivot as far around the dowel 116 or move as far away from the riser 102 in the $Z_1$-direction (see FIG. 1), so the effect of the contact with the posts 136, 138 changes how far the limb 104 bends, similar to changing the tiller of the bow.

FIG. 5 shows a configuration of the embodiment of FIGS. 2-4 where the posts 136, 138 unevenly extend from the limb-facing surface 140 of the bolt head 134. With the limb 104 in tension as shown, the proximal end 120 of the limb 104 twists around the longitudinal axis L of the limb 104 due to one lateral side of the proximal end 120 being able to move closer to the bolt head 134 than the other lateral side of the proximal end 120. This rotation of the limb 104 around the longitudinal axis L may affect the position of the distal end 122 of the limb 104. Thus, an archer may adjust the posts 136, 138 as needed to change the angle at which the limb 104 rests against the bolt head 134 when the bow is drawn and thereby affect the position of the bowstring 124 relative to the riser 102.

At the same time, if the bow 100 includes a dowel 116 (as shown in these figures), the limb 104 may be laterally adjusted at the dovetail bolt 118. Adjustment of the dowel 116 may move the limb 104 laterally with respect to the limb pocket 112 at the dovetail bolt 118, such as along the $X_1$-axis shown in FIG. 2. If the limb 104 is laterally fixed at the limb bolt 114, adjustment of the dowel 116 may cause the limb 104 to rotate around the $Z_1$-axis (see FIG. 1), and if the limb 104 is not fixed by the bolt 114 (such as if the bolt aperture 144 is wider than the shaft 142) then the limb 104 may translate laterally along the $X_1$-axis (see FIG. 2). Thus, using the dowel 116 and posts 136, 138 in conjunction may give the archer fine control over many aspects of the way the limb 104 extends from the riser 102.

Figure 6:
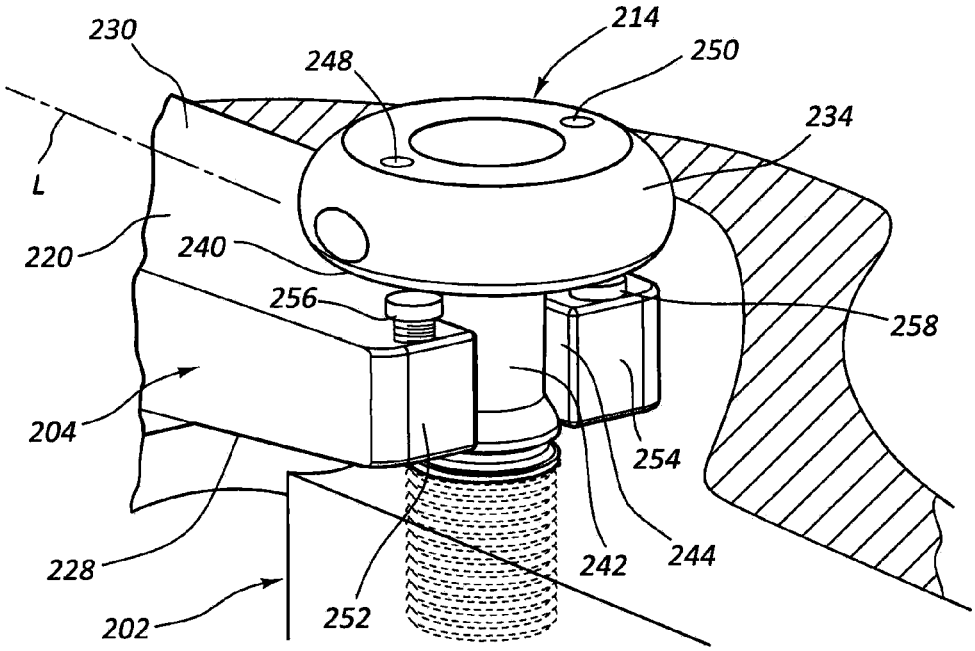
FIG. 6 is a detail view of an archery bow having a limb with adjustable posts.
Figure 7:
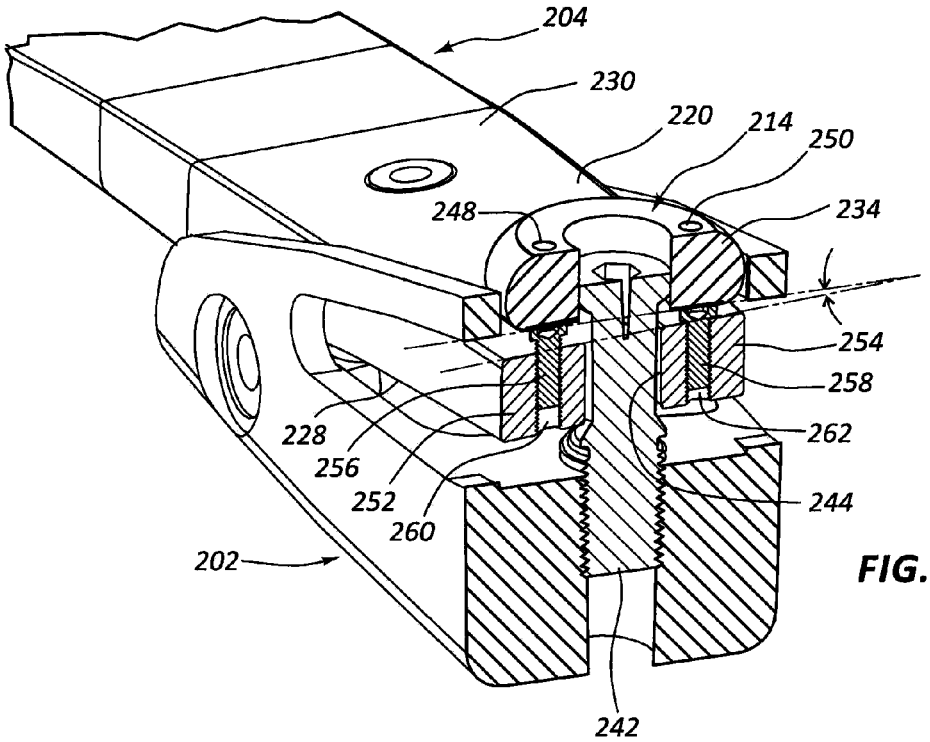
FIG. 7 is a section view of the archery bow of FIG. 6 taken through section lines 7-7 in FIG. 2 with the limb rotated.
Figure 8:
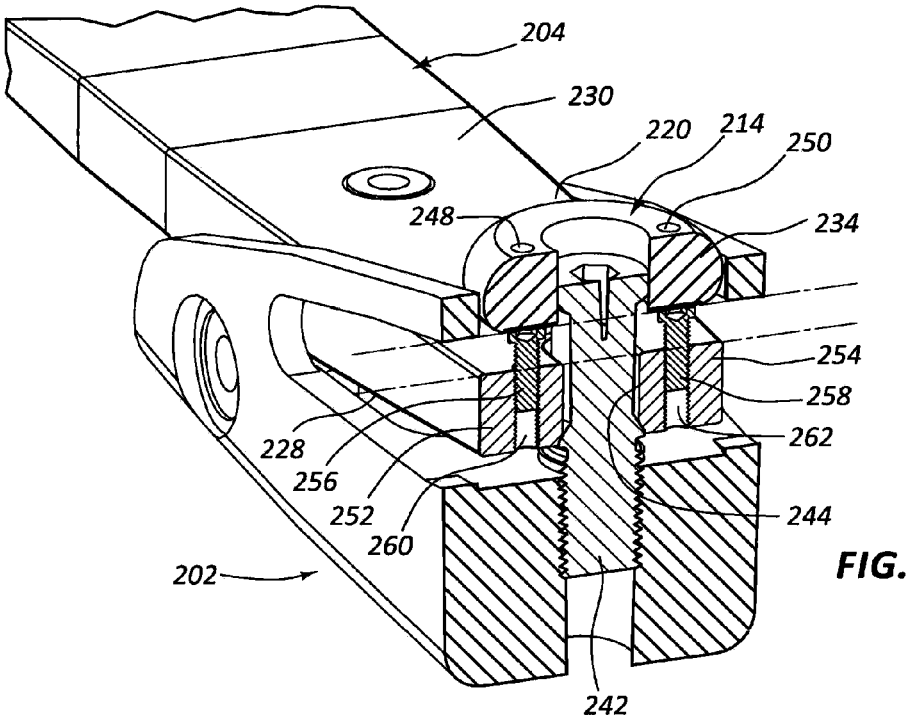
FIG. 8 is a section view of the archery bow of FIG. 7 with the limb unrotated.

FIGS. 6-8 show another embodiment of a limb adjustment system in which a limb 204 is adjustable relative to a riser 202. Here, the proximal end 220 of the limb 204 is held to the riser 202 by a limb bolt 214 extending through a bolt aperture 244 in the limb 204. The limb bolt 214 may have a shaft 242 within the bolt aperture 244 between a first side portion 252 and a second side portion 254 of the proximal end 220. The first and second side portions 252, 254 may comprise adjustable posts 256, 258 extending from an outward-facing side 230 of the limb 204 under the limb-facing surface 240 of the bolt head 234. The adjustable posts 256, 258 may be adjusted by access from the side (i.e., between the limb-facing surface 240 of the bolt head 234 and the outward-facing side 230 of the limb 204), from the riser-facing side 228 of the limb (see openings 260, 262 in FIG. 7), or through post adjustment openings 248, 250 in the bolt head 234. In some embodiments, the first and second side portions 252, 254 may extend proximally around the shaft 242 of the limb bolt 214, and may in some cases also be proximally connected to each other. The limb 204 may be retained to the riser 202 at least in part by a dovetail bolt and/or dowel in the manner illustrated in FIGS. 1-5. In some embodiments, the limb 204 may comprise only one post 256 or 258.

FIGS. 7-8 show section views of the proximal end 220 of the limb 204 with the limb 204 subject to tension. The section views are taken through section lines 7-7 in FIG. 2. In FIG. 7, one adjustable post 256 extends further from the outward-facing side 230 of the limb 204 than the other adjustable post 258, so when the limb 204 is under tension, the limb 204 pivots around the longitudinal axis L (e.g., around axes $Y_1$ and/or $Z_1$ in FIG. 1). Thus, the outward-facing side 230 is not parallel to the limb-facing surface 240 of the bolt head 234, and the distal end of the limb 204 may be turned. By adjusting the posts 256, 258 to have the same height, as shown in FIG. 8, the distance that the limb 204 travels when under tension may be adjusted.

FIG. 6 in particular shows the orientation of the proximal end 220 of the limb 204 relative to the limb bolt 214 and the riser 202. The limb 104 of FIGS. 1-5 may also have first and second portions 252, 254 as shown in FIG. 6. In some embodiments, the embodiment of FIG. 6 may have a limb bolt head 234 that has posts (e.g., posts 136, 138) in addition to the posts 256, 258 shown. In these embodiments, the posts 136, 138, 256, 258 may be aligned along their longitudinal axes, or may be offset proximally, distally, or laterally when compared to the longitudinal axis L of the limb.

Figure 9A:
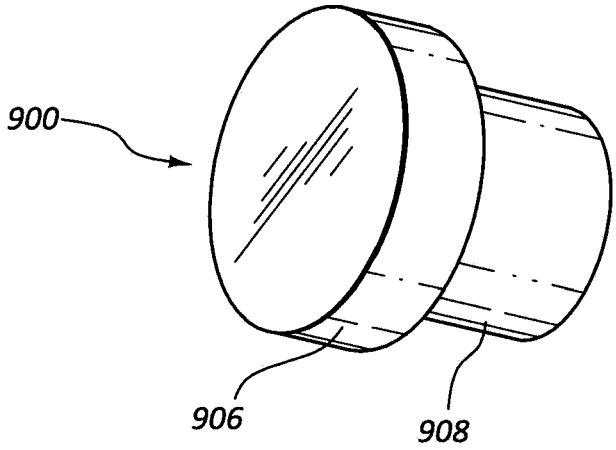
FIGS. 9A-9C show embodiments of adjustable posts that may be used in embodiments of the present disclosure.
Figure 9B:
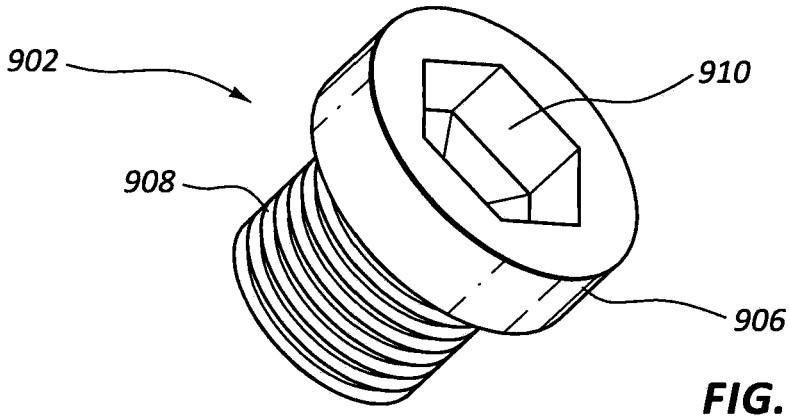
Figure 9C:
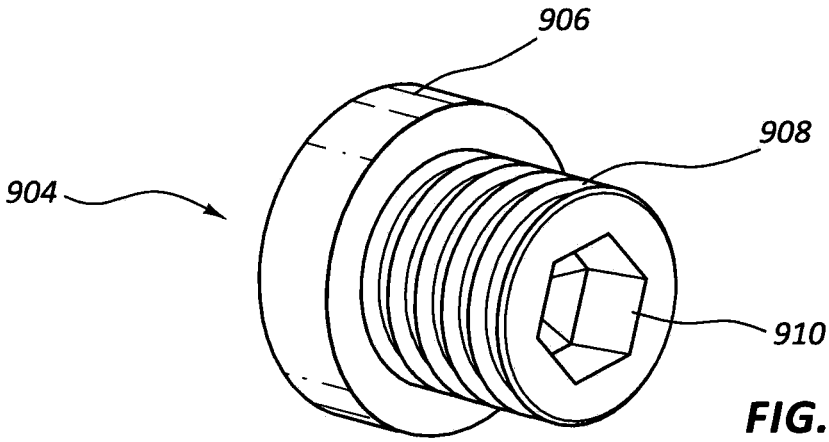

FIGS. 9A-9C illustrate example embodiments of posts 900, 902, 904 suitable for use in the embodiments shown in FIGS. 1-8. Each example post 900, 902, 904 may comprise a post head 906 and a post shaft 908.

In post 900, the head 906 and shaft 908 may be smooth and uninterrupted by openings, apertures, depressions, and other shapes. This post 900 may beneficially be press-fit or interference-fit into a bow. Alternatively, this post 900 may be interchangeable with other posts having a different length of shaft 908 or thickness of head 906 so that each interchangeable post extends from the limb or limb bolt at a different length or height.

Post 902 comprises a threaded shaft 908 that allows the post 902 to be adjusted when inserted into a threaded opening in the limb or limb bolt. For example, the post adjustment openings 148, 150, 260, 262 may be threaded to receive threads of the shaft 908 of the post 902 so that turning the shaft 908 reversibly adjusts the position of the post 902 in the bow. Thus, the post head 906 may comprise a driver feature 910 such as, for example, an opening or depression in the post head 906 that allows the post 902 to be turned by insertion of a tool. In the embodiment of FIG. 9B, the driver feature 910 is shaped to receive a hex or Allen wrench, but it may be adapted to receive other tools (e.g., screwdrivers). The driver feature 910 may be accessible through the bolt head (e.g., through openings 148, 150) or from the outward-facing surface. Post 904 of FIG. 9C is similar to post 902 but shows that a driver feature 910 may be positioned opposite the head 906 of the post 904. Thus, the driver feature 910 may be accessible through the limb (e.g., through openings 260, 262). The threaded posts 902, 904 may be interchangeable in the limb and/or limb bolt for posts that have longer or shorter longitudinal dimensions.

Figure 10:
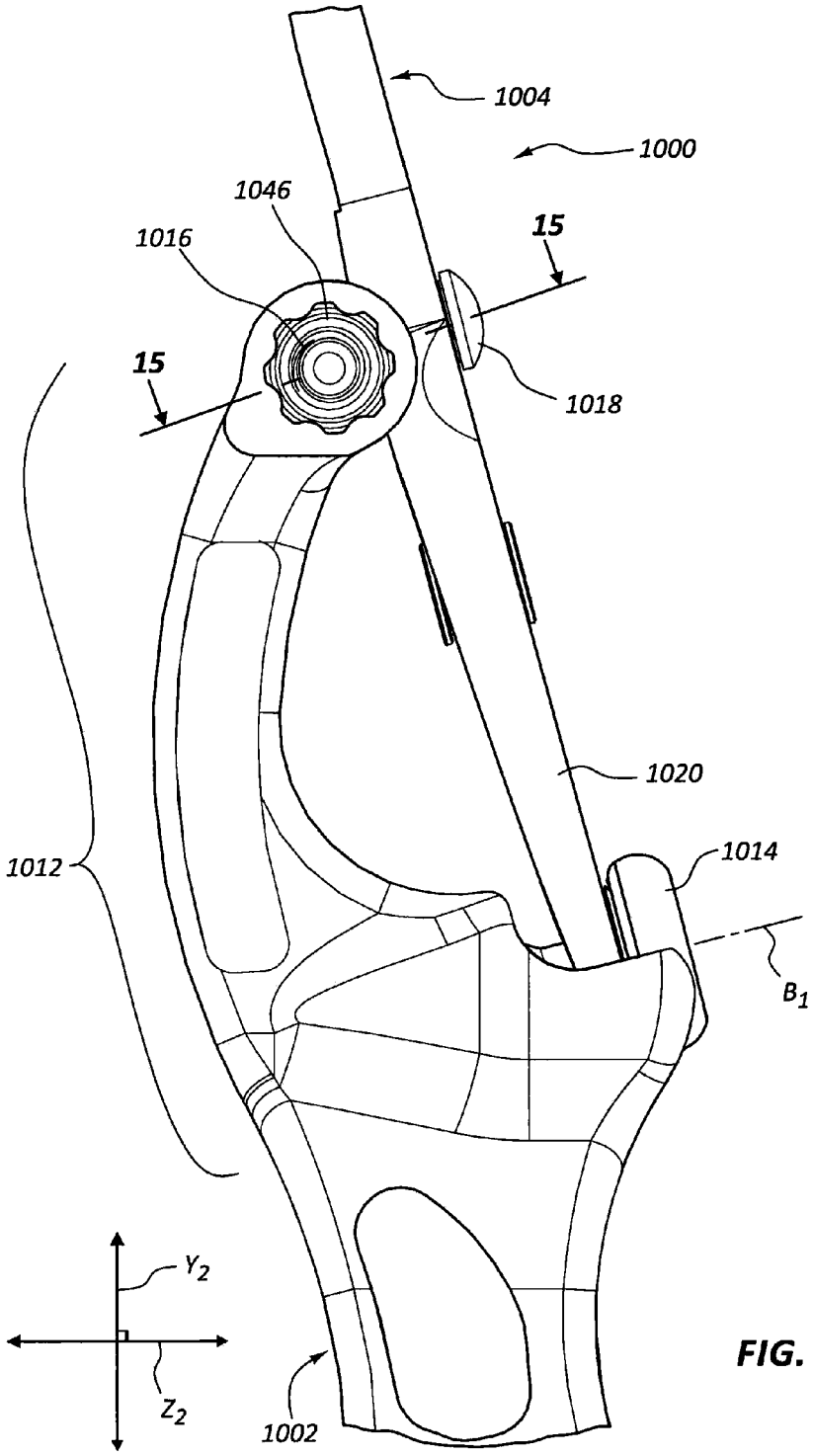
FIG. 10 is a side view of another embodiment of an archery bow.
Figure 11:
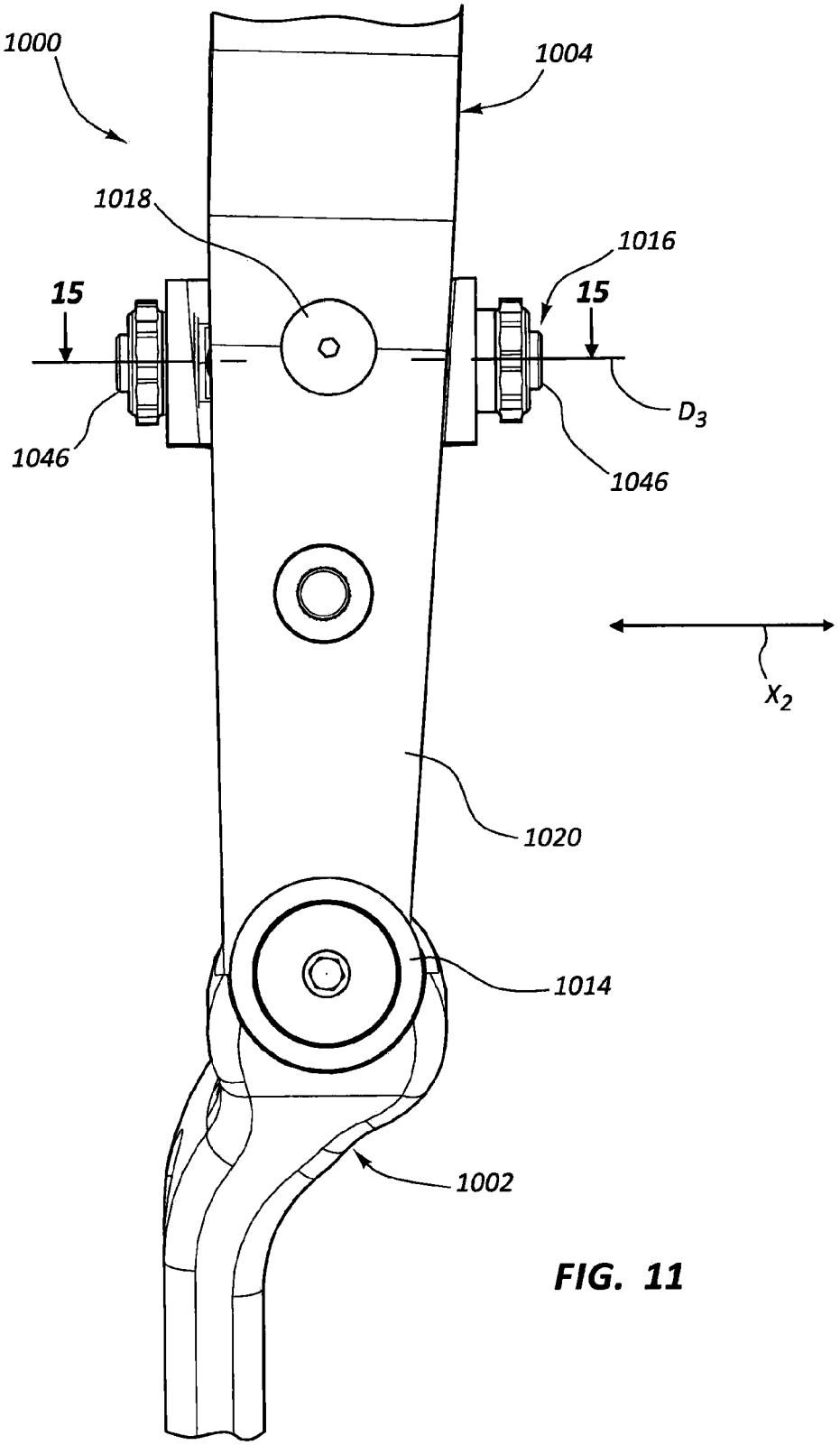
FIG. 11 is a front detail view of the archery bow of FIG. 10.

FIGS. 10-11 illustrate another example embodiment of a bow 1000 having a riser 1002 and a limb 1004 attached to the riser 1002 in a limb pocket 1012. The proximal end 1020 of the limb 1004 may be secured to the riser 1002 by a limb bolt 1014. The limb 1004 may be retained to the riser 1002 distal to the limb bolt 1014 by a dovetail bolt 1018 that extends through the limb 1004 to interlock with an adjustable dowel 1016 retained in the outer end of the riser 1002. Adjustment of an end portion 1046 of the dowel 1016 may cause the dovetail bolt 1018 to translate along the $X_2$-axis (shown in FIG. 11). In some embodiments, the limb 1004, limb bolt 1014, and dowel 1016 of FIGS. 10-11 may alternatively be used in the risers 102, 202 previously shown herein. In some embodiments, only one end portion 1046 of the dowel 1016 may be manipulated to alter the lateral position of the limb 1004.

Figure 12:
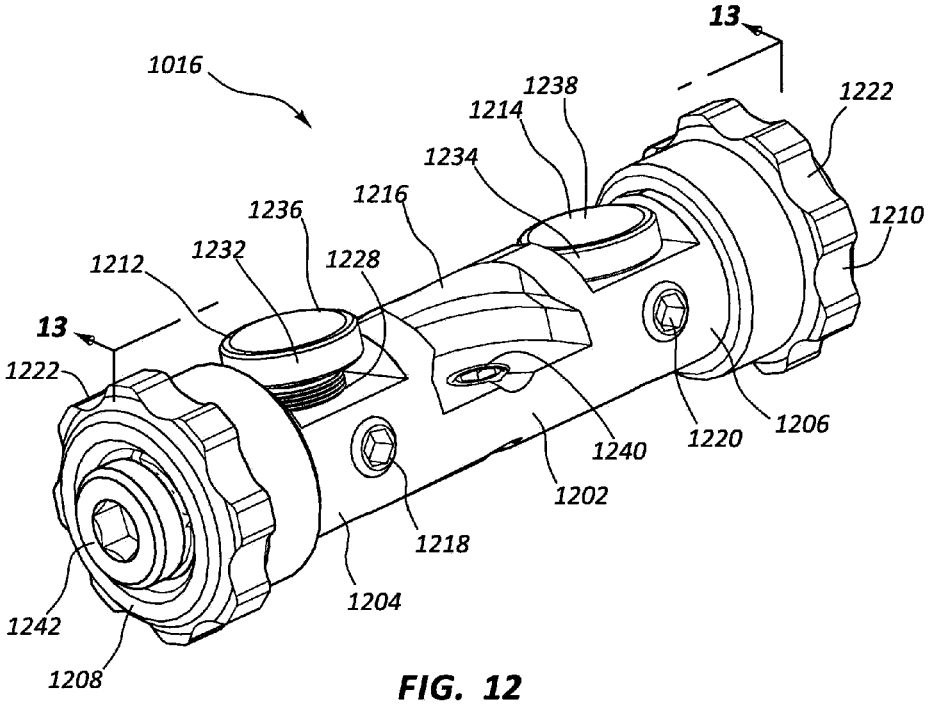
FIG. 12 is a view of an adjustable dowel for use in an archery bow.
Figure 13:
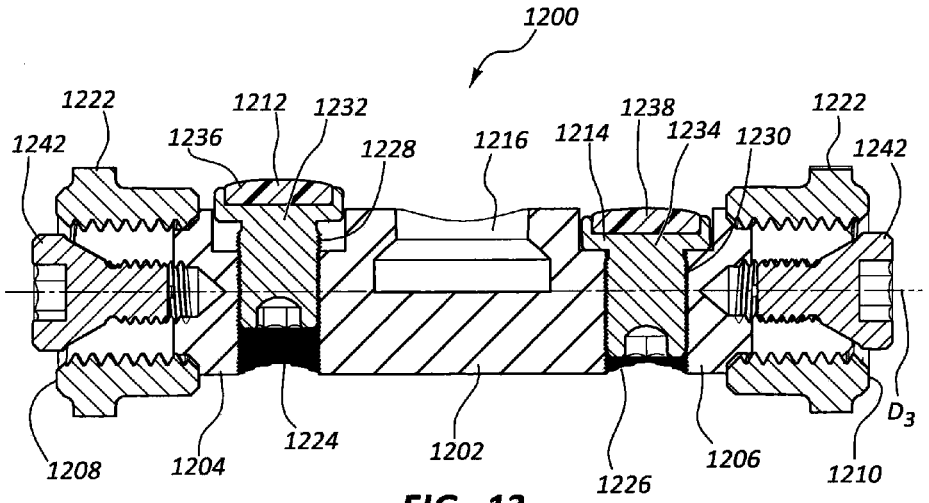
FIG. 13 is a section view of the dowel of FIG. 12 taken through section lines 13-13.
Figure 14:
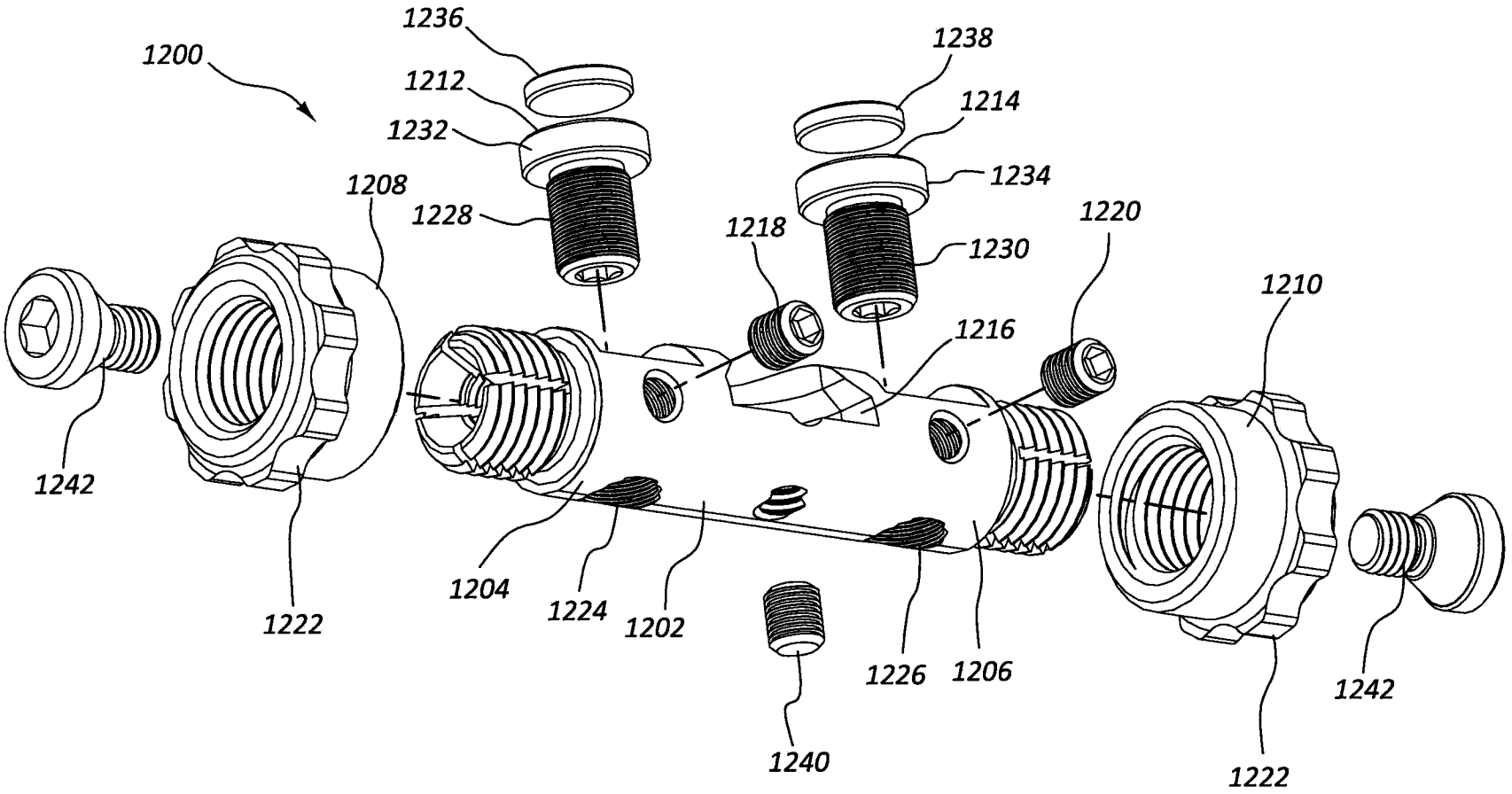
FIG. 14 is an exploded view of the dowel of FIG. 12.

FIGS. 12-14 show an example embodiment of a dowel 1016 configured for use in an archery bow. The dowel 1016 may comprise a main body portion 1202, which may alternatively be referred to as a main cylinder or a shaft. The body portion 1202 may have a first end 1204 and a second end 1206. The first and second ends 1204, 1206 may include lateral adjustment portions 1208, 1210. The lateral adjustment portions 1208, 1210 may be operated to translate the body portion 1202 laterally (e.g., along the $X_2$-axis in FIG. 11). The first and second ends 1204, 1206 may respectively hold adjustable posts 1212, 1214. A dovetail bolt retaining recess 1216 may be positioned between the adjustable posts 1212, 1214, and set fasteners 1218, 1220 may be positioned perpendicular to the adjustable posts 1212, 1214 in the body portion 1202.

The lateral adjustment portions 1208, 1210 may be threadably engaged with the first and second ends 1204, 1206 of the body portion 1202, respectively. Thus, with the dowel 1016 installed in the riser (e.g., in the manner shown in FIG. 11), an archer may adjust the lateral position of the limb via the dovetail bolt by turning the lateral adjustment portions 1208, 1210 in opposite directions. In some embodiments, the adjustment portions 1208, 1210 are turned by rotating their outer circumferential surfaces 1222 relative to the body portion 1202. The circumferential surface 1222 may comprise grooves and ridges to improve the archer's ability to turn the adjustment portions 1208, 1210. In some embodiments, the surfaces 1222 may be shaped to be turned by a tool such as, for example, a wrench or pliers. With the adjustment portions 1208, 1210 threaded to a desired position on the body portion 1202, the adjustment portions 1208, 1210 may be locked in place relative to the ends 1204, 1206 by a locking fastener 1242 (see FIG. 14). The locking fastener 1242 may be tightened into a threaded bore in the end (e.g., first end 1204) of the body portion 1202 and expand the threads at the end of the body portion 1202, thereby applying pressure to the inside of the adjustment portion 1208 and preventing it from moving relative to the body portion 1202. In this manner, a locking fastener 1242 may be used to reversibly immobilize the adjustment portions 1208, 1210.

The adjustable posts 1212, 1214 may be installed in bores 1224, 1226 extending through the body portion 1202 of the dowel 1016. The bores 1224, 1226 may be threaded to engage threading on shafts 1228, 1230 of the adjustable posts 1212, 1214. The bores 1224, 1226 may extend entirely through the body portion 1202 as shown or may extend partially through the body portion 1202. In some embodiments, the shafts 1228, 1230 may not be threaded, but may be retained in the bores 1224, 1226 by the set fasteners 1218, 1220 without being threaded to the bores 1224, 1226. The ends of the shafts 1228, 1230 may be configured to receive a tool to allow the posts 1212, 1214 to be turned and moved relative to the body portion 1202. For example, in FIG. 13, the posts 1212, 1214 are shown at different heights relative to the upper surface of the body portion 1202 of the dowel 1016 due to post 1212 being extended away relative to the body portion 1202 and post 1214 being withdrawn relative to the body portion.

The adjustable posts 1212, 1214 may have head portions 1232, 1234 that are broadened relative to the shaft portions 1228, 1230. The surfaces of the head portions 1232, 1234 extending away from the body portion 1202 may be configured to contact the limb adjacent to the dowel (see FIG. 15), and may be flattened to support the limb. In some embodiments, a polytetrafluoroethylene (PTFE) or other slide-enhancing material or coating may be applied to enhance the ability of the head portions 1232, 1234 to rotate and for the limb to slide along the contact surface. The outer ends of the adjustable posts 1212, 1214 may have slide portions 1236, 1238 attached (see FIG. 14) that facilitate sliding along the limb and may act as wear pads that may be replaced upon sufficient wear against a limb.

The dovetail bolt retaining recess 1216 may be shaped to receive the inside end of a dovetail bolt. See also FIGS. 15-16. In some embodiments, the dovetail bolt may be integrated into the body portion 1202 of the dowel 1016, so a dovetail bolt retaining recess 1216 may not be present. A dovetail bolt 1018 may also be secured to the dowel by a recess fastener 1240 extending through the bottom surface of the dovetail bolt retaining recess 1216. See FIG. 14. The dovetail bolt retaining recess 1216 may be positioned centrally along the body portion 1202 or may be positioned centrally between the adjustable posts 1212, 1214, depending on the design of the body portion 1202. The dovetail bolt retaining recess 1216 may be sized to keep the end of a dovetail bolt 1018 from being radially pulled out of the dowel 1016 but may still allow the dovetail bolt 1018 to pivot or tilt relative to the body portion 1202. Thus, with a dovetail bolt 1018 securely fixed perpendicularly through the limb 1004, the limb 1004 may be kept from separating from the dowel 1016, but may also tilt relative to the longitudinal axis $D_3$ of the dowel 1016. In some embodiments, the recess fastener 1240 may be used to prevent the dowel 1016 from moving relative to the riser 1002, such as by tightening the recess fastener 1240 against the riser 1002.

The set fasteners 1218, 1220 may extend through the body portion 1202 into contact with the shafts 1228, 1230 of the posts 1212, 1214. In some embodiments, the set fasteners 1218, 1220 may be screws or bolts that may be tightened against the shafts 1228, 1230 to keep the shafts 1228, 1230 from shifting or turning while the bow is in use. The set fasteners 1218, 1220 may be loosened when desired in order to allow the posts 1212, 1214 to be adjusted. Some embodiments may omit set fasteners 1218, 1220, such as where the posts 1212, 1214 are removable, but do not have adjustable height while installed in the body portion 1202.

Figure 15:
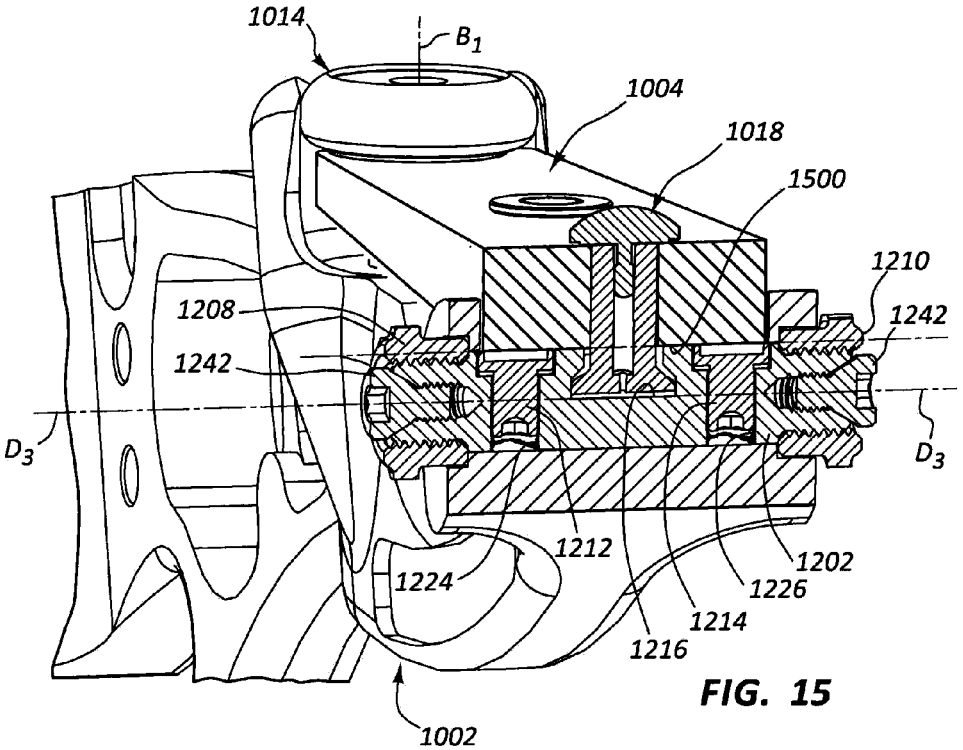
FIG. 15 is a section view of the archery bow of FIG. 10 taken through section lines 15-15.
Figure 16:
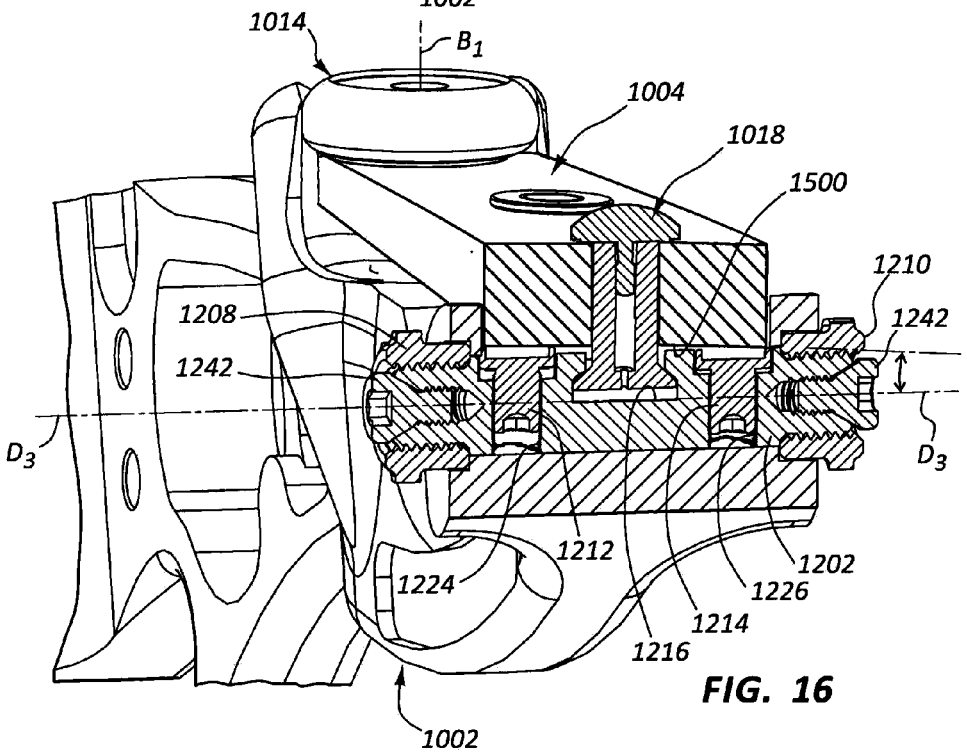
FIG. 16 is another section view of the archery bow of FIG. 10 taken through section lines 15-15 with the limb rotated.
Figure 17:
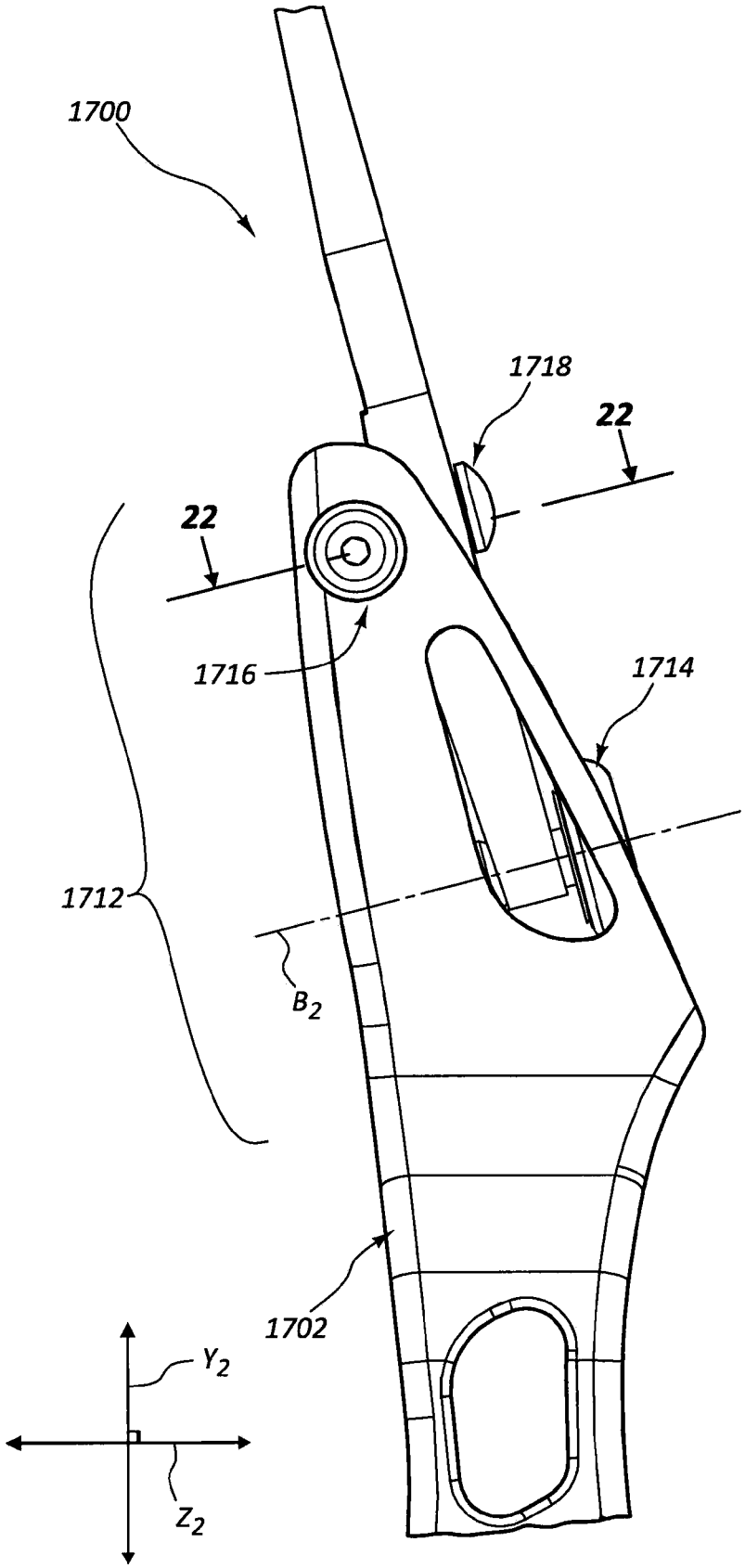
FIG. 17 is a side view of another embodiment of an archery bow.
Figure 18:
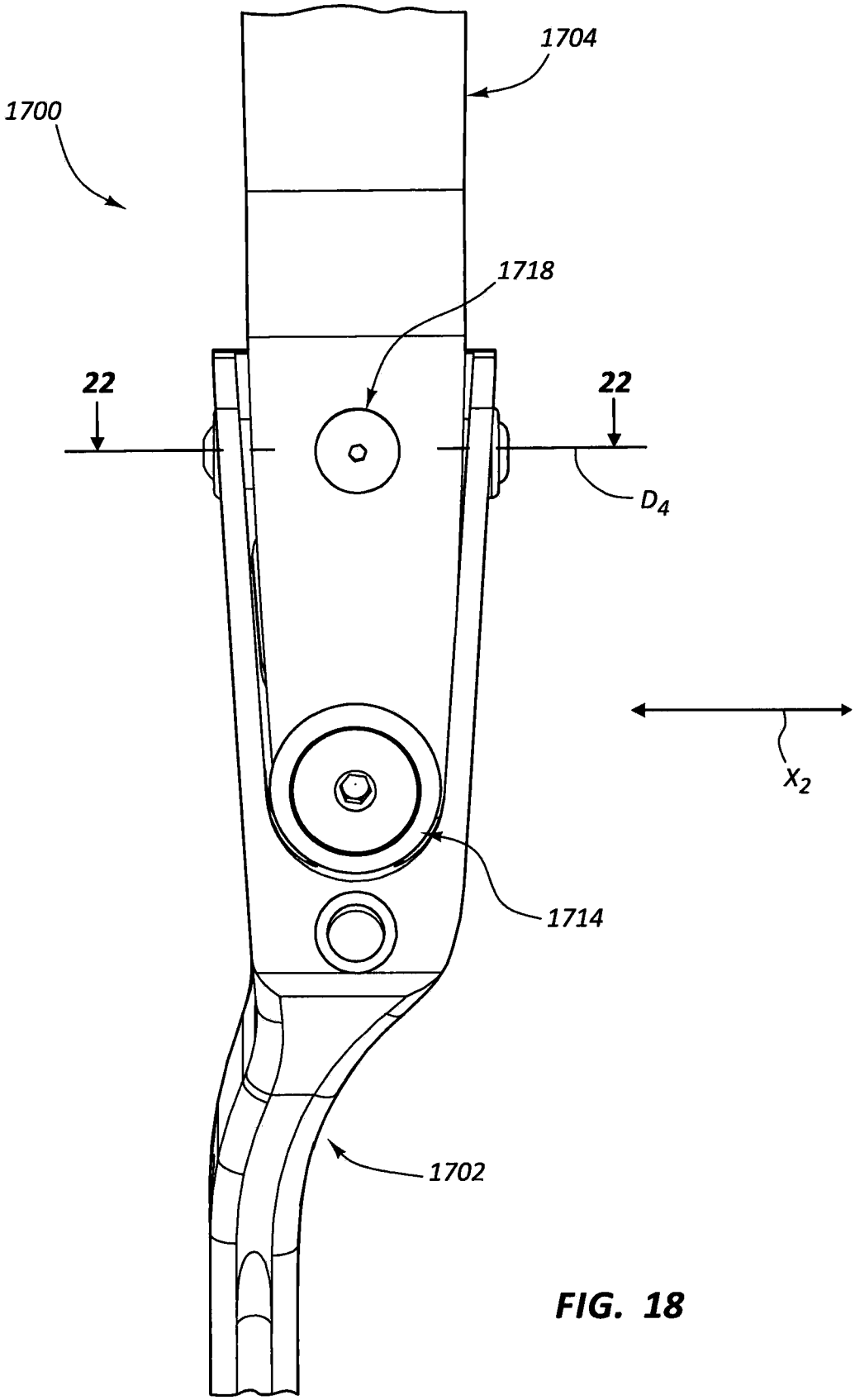
FIG. 18 is a front detail view of the archery bow of FIG. 17.

FIGS. 15-16 show a section view through section lines 15-15 of the dowel 1016 installed in the riser 1002 with the limb 1004 of FIGS. 10-11. With the dowel 1016 installed in the riser 1002, the limb 1004 may have a riser-facing surface 1500 in contact with adjustable posts 1212, 1214. The surfaces of the adjustable posts 1212, 1214 and body portion 1202 facing the limb 1004 may be defined as limb-facing surfaces. When adjustable posts 1212, 1214 extend evenly from the dowel 1016, as in FIG. 15, the riser-facing surface 1500 is parallel to a longitudinal axis $D_3$ running through the dowel 1016 and perpendicular to a longitudinal axis $B_1$ running through the limb bolt 1014. When adjustable posts 1212, 1214 are unevenly spaced from the body portion 1202, as in FIG. 16, the riser-facing surface 1500 is non-parallel to longitudinal axis $D_3$ and non-perpendicular to longitudinal axis $B_1$. The rotation of the limb 1004 may change the position of the distal end of the limb and, therefore, the bowstring.

FIGS. 17-23 depict yet another embodiment of a bow 1700 having a riser 1702 and an attached limb 1704. The limb 1704 is more enclosed by limb pocket portion 1712 than the riser 1002 of FIG. 10. A limb bolt 1714, dowel 1716, and dovetail bolt 1718 are also included in the bow 1700. A longitudinal axis $D_4$ (see FIG. 18) may extend through the dowel 1716 and a longitudinal axis $B_2$ (see FIG. 17) may extend through the limb bolt 1714.

Figure 19:
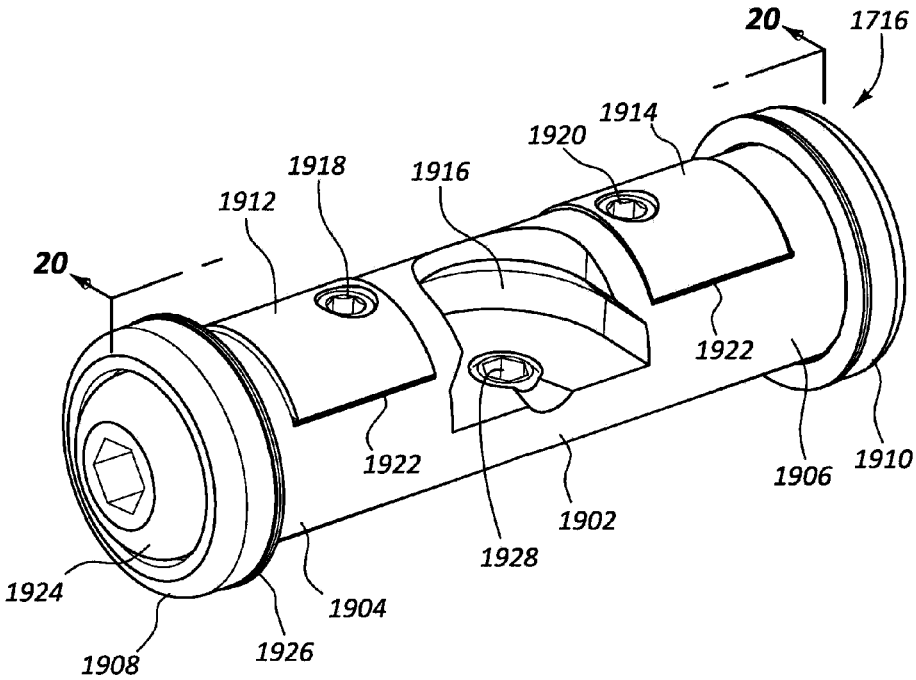
FIG. 19 is a view of another adjustable dowel for use in an archery bow.
Figure 20:
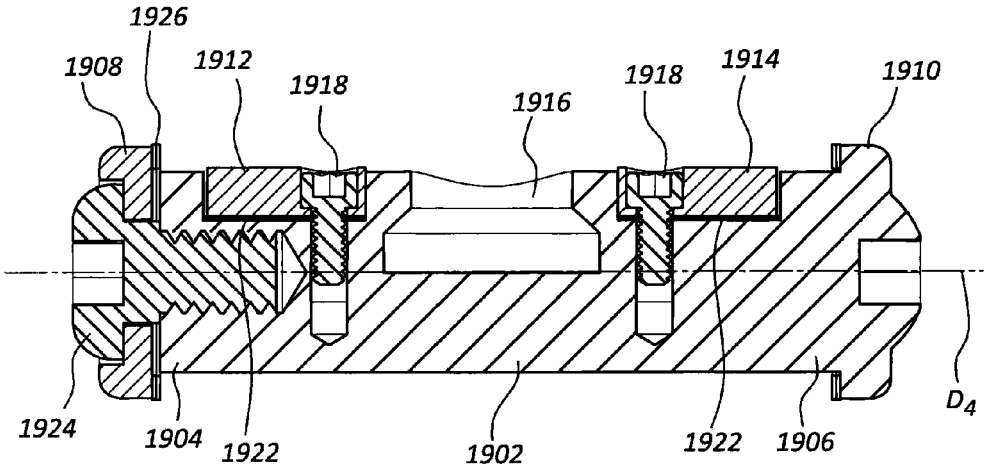
FIG. 20 is a section view of the adjustable dowel of FIG. 19 taken through section lines 20-20.
Figure 21:
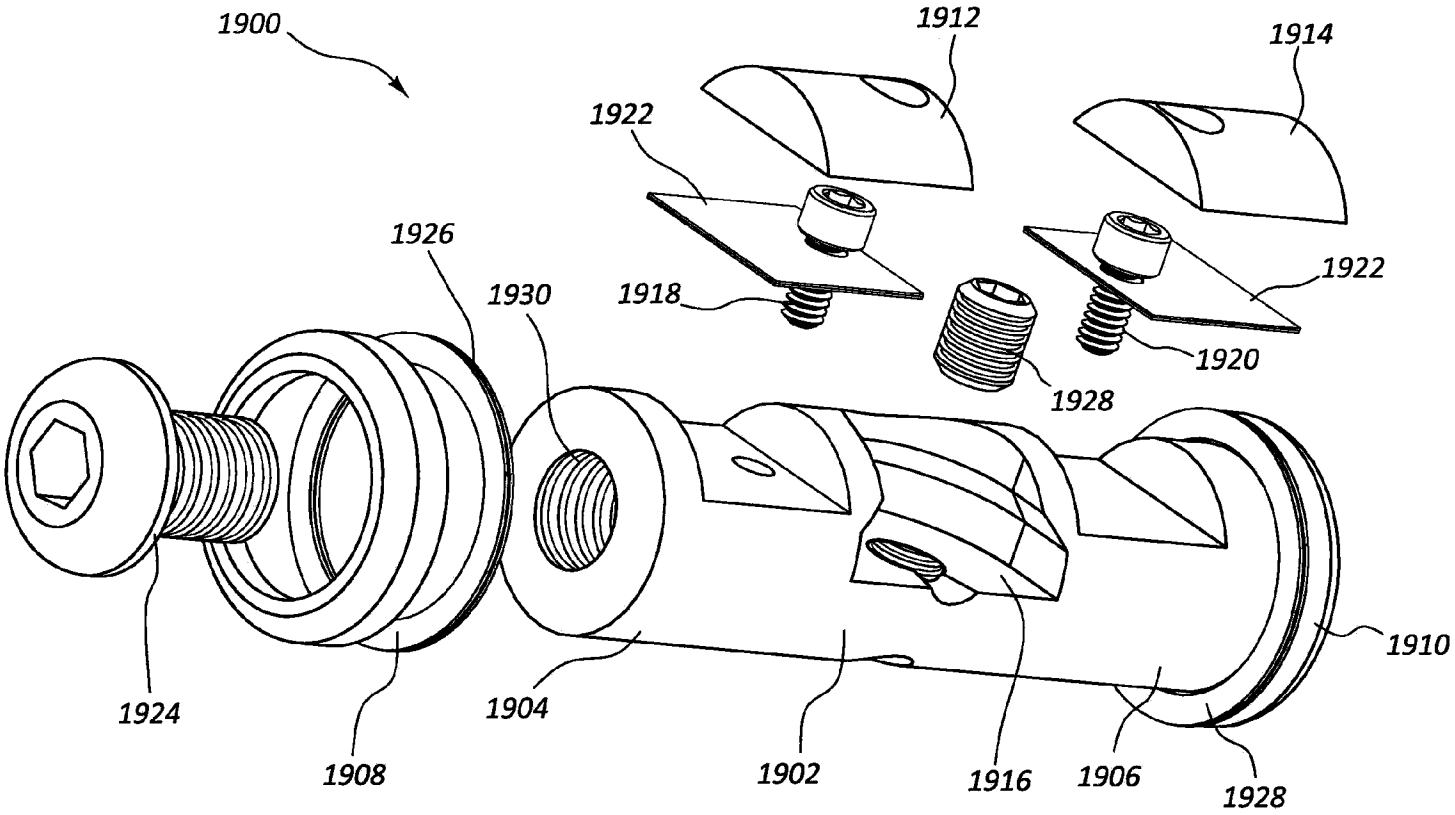
FIG. 21 is an exploded view of the dowel of FIG. 19.

As discussed with reference to dowel 1016, dowel 1716 may be configured to translate the dovetail bolt 1718 and, therefore, the limb 1704, along the $D_4$ axis. FIGS. 19-21 show detailed views of the dowel 1716. As with dowel 1016, dowel 1716 may comprise a body portion 1902, first and second ends 1904, 1906, two adjustment portions 1908, 1910, and a dovetail bolt retaining recess 1916. The dovetail bolt retaining recess 1916 may have a recess fastener 1928 at its base. These elements may have features described in connection with corresponding elements of FIGS. 10-16 herein.

Shim plates 1912, 1914 are positioned at the first and second ends 1904, 1906, respectively, one on each side of the dovetail bolt retaining recess. The shim plates 1912, 1914 may be shaped to mimic the cylindrical shape of the body portion 1902. For example, the outward-facing surfaces of the shim plates 1912, 1914 may be curved where they contact a limb, as shown in FIG. 19. The shim plates 1912, 1914 may alternatively have flattened surfaces such as the flattened surfaces shown in connection with the head portions 1232, 1234 of the adjustable posts 1212, 1214 described herein. The shim plates 1912, 1914 may be secured to the body portion 1902 by fasteners 1918, 1920. The fasteners may be removable from the shim plates 1912, 1914 to allow the shim plates 1912, 1914 to be removed and so that shims may be installed between the plates 1912, 1914 and the body portion 1902. In some embodiments, the shim plates 1912, 1914 may be removed and exchanged for shim plates 1912, 1914 having different dimensions (e.g., thicknesses or outer shapes) in addition to or in alternative to the installation of shims. In some arrangements the fasteners 1918, 1920 may be accessible through the body portion 1902 instead of being accessible from the limb-facing surface of the dowel 1716.

Shims 1922 may be configured to be inserted between the shim plates 1912, 1914 and the body portion 1902. The shims 1922 may be thin plates held in position by pressure applied by the fasteners 1918, 1920 against the shim plates 1912, 1914. Shims 1922 may also be held in position by the fasteners 1918, 1920 extending through an opening or slot in each shim 1922. See FIG. 21. Thus, the shims 1922 may be removable to allow the archer to readjust the distance between the limb-facing upper surface of the shim plates 1912, 1914 and the body portion 1902. The surface of the body portion against which the shims 1922 rest may be referred to as a limb-facing surface of the dowel 1716 or a shim mounting surface.

The dowel 1716 may also include an end bolt 1924 to secure the adjustment portion 1908 to the body portion 1902. The distance between the adjustment portion 1908 and body portion 1902 may be controlled by dowel shims 1926 placed between them.

Figure 22:
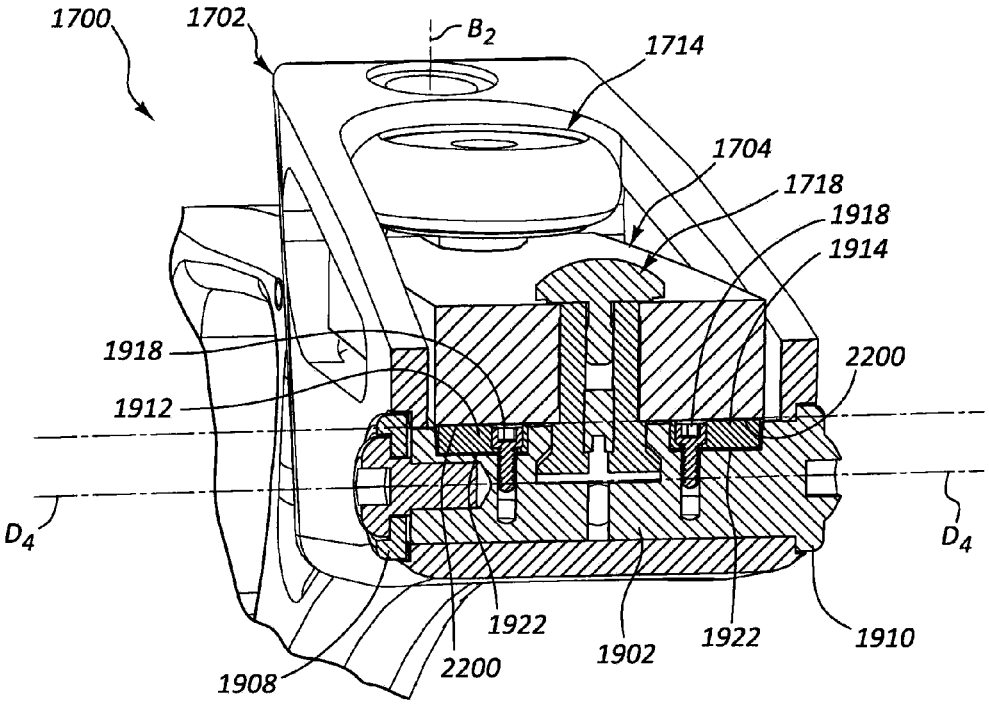
FIG. 22 is a section view of the bow of FIG. 17 taken through section lines 22-22 in FIG. 18.

As shown in FIG. 22, when a corresponding thickness or number of shims 1922 are inserted on each side of the dovetail bolt 1718, the riser-facing surface 2200 of the limb 1704 may be parallel to the axis $D_4$ of the dowel 1716 and perpendicular to the axis $B_2$ of the limb bolt 1714. A similar effect is produced by shim plates 1912, 1914 producing the same thickness.

Figure 23:
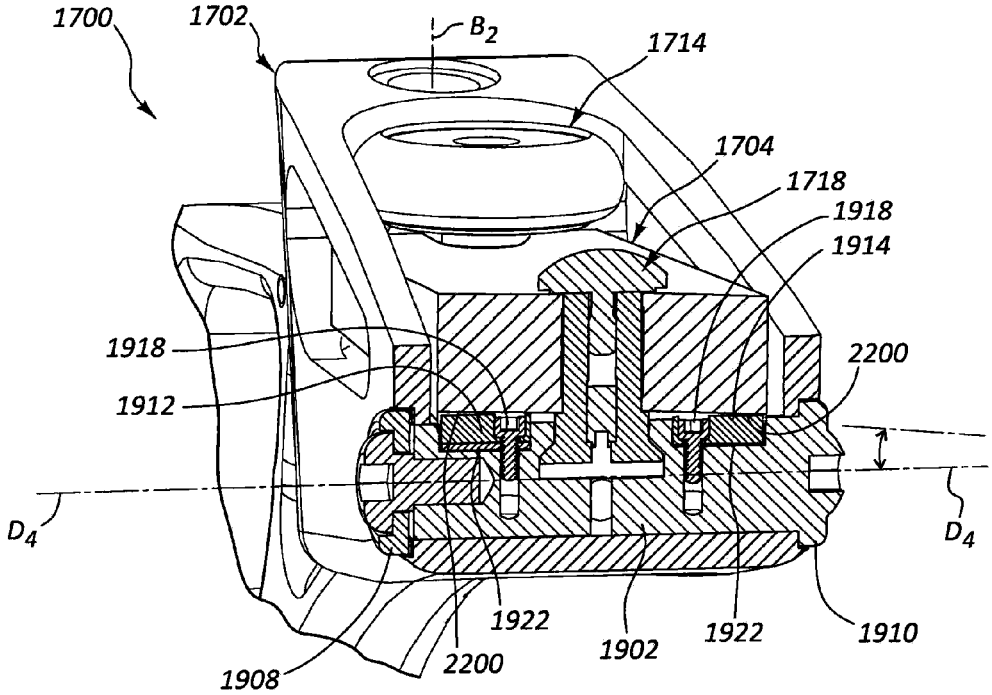
FIG. 23 is a section view of the bow of FIG. 17 taken through section lines 22-22 with the limb rotated.

FIG. 23 shows that when a non-corresponding thickness or number of shims are inserted on each side of the dovetail bolt 1718, the riser-facing surface 2200 may not be parallel to the axis $D_4$ and non-perpendicular to the axis $B_2$. By adjusting the angle between the riser-facing surface 2200 and the dowel 1716, the distal end of the limb 1704 may be adjusted and rotated.

Figure 24:
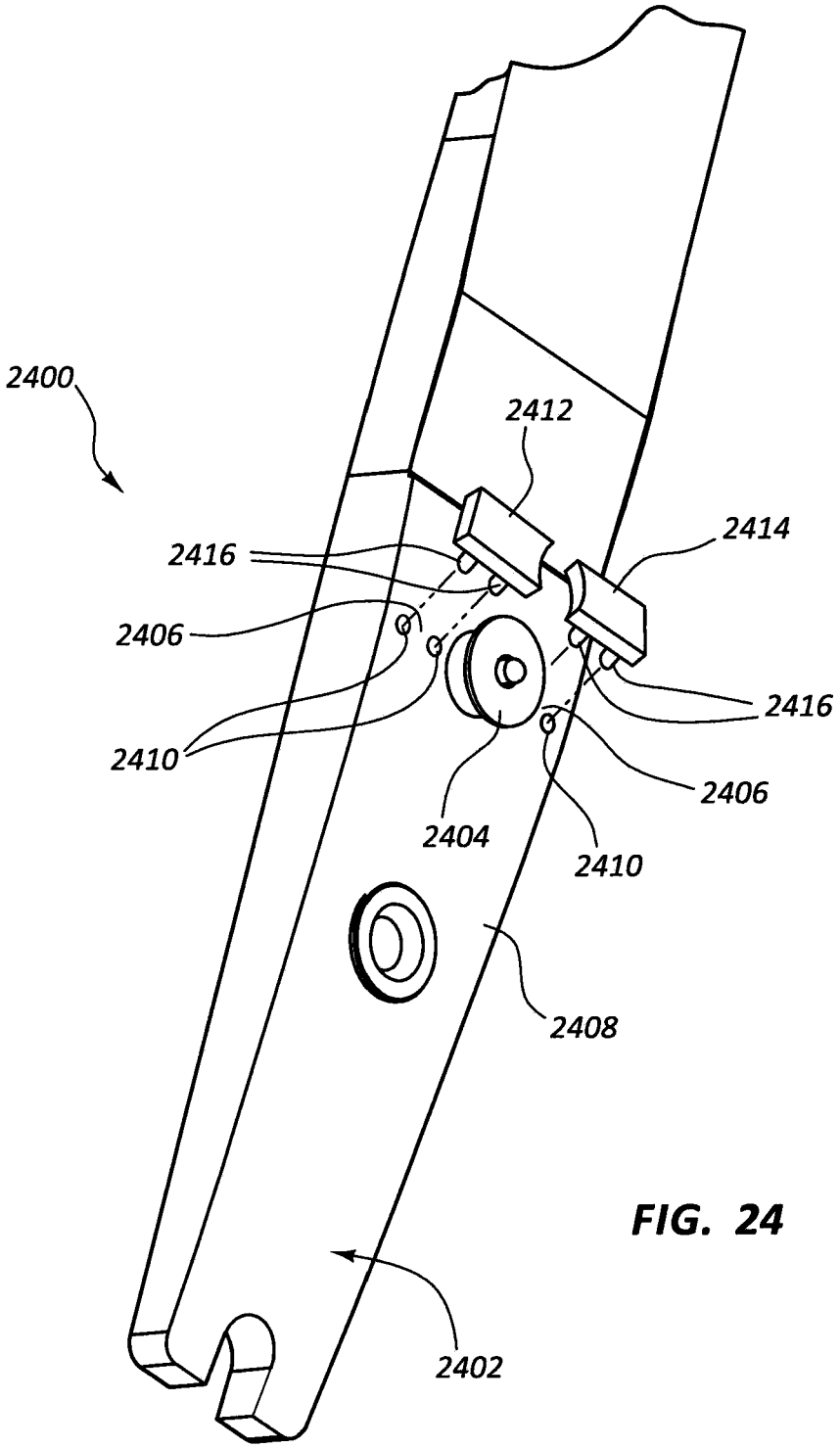
FIG. 24 is a view of a dovetail shim adjustment assembly.

FIG. 24 shows yet another embodiment of a system for rotating the proximal end of a limb 2400. The limb 2400 may have a proximal end 2402 configured to be inserted into a limb pocket. A dovetail bolt 2404 may extend from a portion of the limb 2400. A shim retaining surface 2406 may be defined on each side of the dovetail bolt 2404 on the riser-facing surface 2408 of the limb 2400. A plurality of openings 2410 may be formed in the shim retaining surface 2406. These openings 2410 may be aligned along an axis perpendicular to the longitudinal axis of the limb 2400 or may form another pattern on each side of the dovetail bolt 2404. Removable shims 2412, 2414 may be attachable to these openings 2410 by posts 2416 extending from the shims 2412, 2414 into the riser-facing surface 2408. These posts 2416 may be configured to retain the shims 2412, 2414 in the openings 2410 by an interference fit, snap fit, or other comparable configuration. In some embodiments, the posts 2416 may only loosely fit within the openings 2410, and pressure between the riser-facing surface 2408 and the dowel or riser to which the limb 2400 is attached may keep the shims 2412, 2414 secured in the openings 2410.

Figure 25:
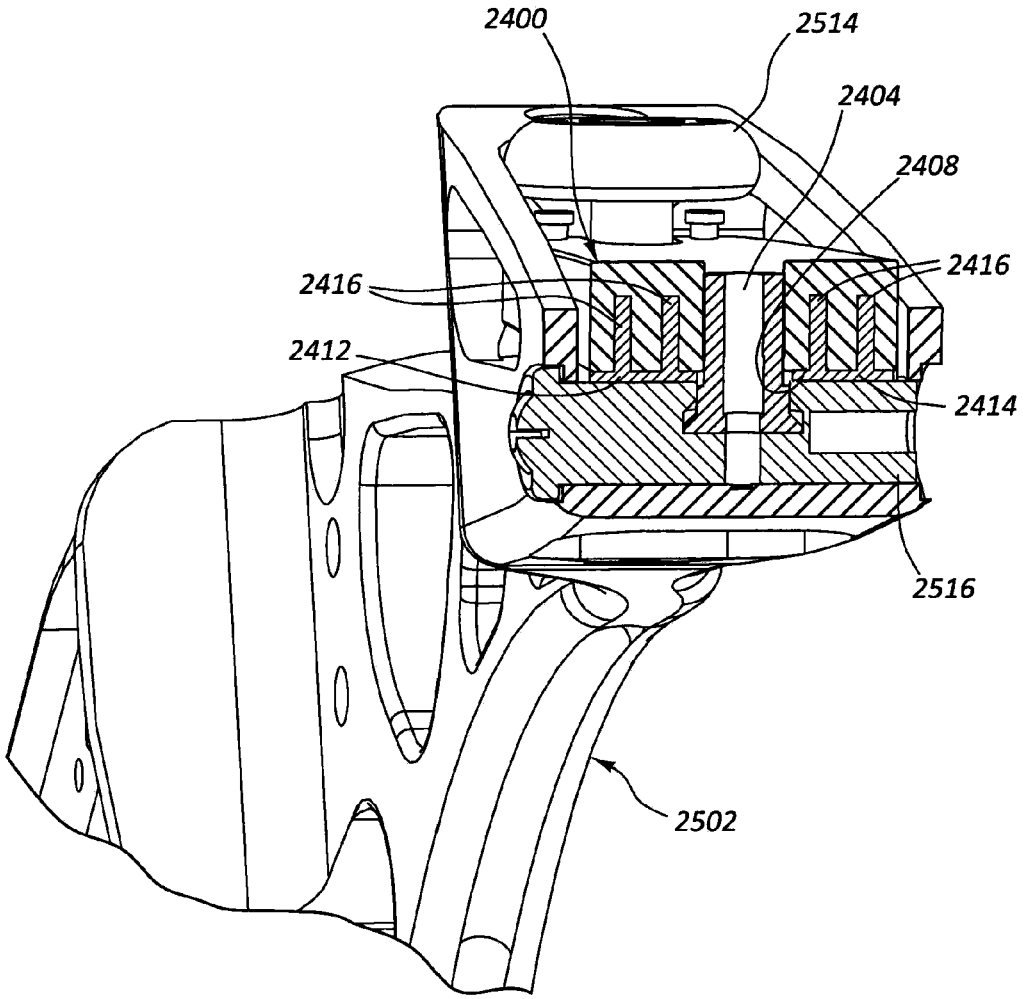
FIG. 25 is a section view of an embodiment of the assembly of FIG. 24 applied in the embodiment of the archery bow of FIG. 1 and taken through section lines 25-25 in FIG. 2.

The shims 2412, 2414 may have the same or different thicknesses, surface shapes, and profiles. Shims 2412, 2414 are shown in the section view of FIG. 25 to show how they may separate the riser-facing surface 2408 of a limb 2400 from a dowel 2516 installed in a riser 2502. This section view is taken through section lines 25-25 in FIG. 2. In embodiments without a dowel 2516, the surface 2408 may be separated from a limb-facing surface by the shims 2412, 2414. Similarly, in embodiments without a dovetail bolt 2404, the shims 2412, 2414 may separate the limb 2400 from the riser 2502 at another portion of the riser-facing surface 2408 that is in contact with the riser 2502. In some embodiments, the posts 2416 of the shims 2412, 2414 may be inserted into openings in the riser 2502 rather than openings 2410 in the limb 2400. If the shims 2412, 2414 have different thicknesses, the limb 2400 may be adjusted around its longitudinal axis, thereby rotating its distal end 2400.

In another aspect of the present disclosure, methods may be provided for assembling and adjusting an archery bow. In one example embodiment, a method may be provided of adjusting the position of a limb of an archery bow that comprises providing a bow assembly. The bow assembly may have a riser having a limb attachment portion or limb pocket, a limb having a distal end extending away from the riser and a proximal end retained at the limb attachment portion of the riser, with the limb having a riser-facing surface an and outer surface, an anchor retaining the proximal end of the limb in the limb attachment portion that has a limb-facing surface, and at least one adjustable separator configured to spread apart the limb-facing surface of the anchor and the outer surface of the limb. The method may further comprise adjusting an angle between the limb-facing surface of the anchor and the outer surface of the limb by adjusting the at least one adjustable separator to at least partially separate the limb-facing surface from the outer surface.

The angle between these surfaces may be adjusted continuously, such as by the adjustment of a threaded post that acts as the adjustable separator, or the angle may be adjusted incrementally, such as by the changing of the number or thickness of shims inserted between the surfaces.

The angle between the surfaces may be defined as the angle between two axes; one running laterally across the limb perpendicular to the longitudinal axis of the limb, and one running laterally across the riser and also perpendicular to the longitudinal axis of the limb (at least before the limb is rotated). Thus, adjusting the adjustable separator (e.g., a shim, shim plus shim plate, adjustable post, or other similar feature) may include changing the height of the adjustable separator relative to the surface to which it is attached.

Adjusting the angle between the limb-facing surface of the anchor and the outer surface of the limb may comprise adjusting the adjustable separators so that the angle between the surfaces changes, such as by adjusting one adjustable separator more than the other or adjusting them so that at least one has a different height than another on the other side of the surfaces being separated. As used herein, the anchor may be a fastener for a bow limb, such as, for example, a limb bolt or a dovetail bolt that anchors the limb to the riser.

In another method, an archery bow limb may be tuned. The method may comprise providing an archery bow having a riser with a limb retaining portion, wherein the limb retaining portion may have a limb-facing surface. The bow may also have a limb retained in the limb retaining portion of the riser, the limb having a riser-facing surface. The bow may have a dowel positioned between the limb-facing surface of the limb retaining portion and the riser-facing surface of the limb, the dowel having a separator extending to a separation distance from the dowel toward the limb. The method may further include adjusting the straightness of the limb relative to the riser by altering the separation distance of the separator. The straightness of the limb may be defined as the difference in angle between a longitudinal vertical axis of the riser and a longitudinal vertical axis of the limb when installed in the riser. Thus, the straightness of the limb may be changed by increasing or decreasing the included angle between these two axes.

The straightness of the limb relative to the riser may be adjustable while the limb is retained by the riser. For example, the separator may be adjusted through an opening in the riser or through the limb. In another example, the separator may be adjusted by access between the limb and the riser.

Altering the separation distance may comprise inserting a removable shim between the separator and the dowel. The separator may alternatively be turned to have its separation distance adjusted. Thus, the separation distance may be altered incrementally or continuously. The limb-facing surface of the riser may be tilted relative to the riser-facing surface of the limb due to altering the separation distance of the separator.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. An archery bow assembly having adjustable limb placement, the bow assembly comprising:

a riser having a limb attachment portion;

a limb having a distal end extending away from the riser and a proximal end retained at the limb attachment portion of the riser, the limb having a riser-facing surface, an outer surface, and a longitudinal axis;

an anchor retaining the proximal end of the limb in the limb attachment portion, the anchor having a limb-facing surface;

at least one adjustable separator configured to spread apart the limb-facing surface of the anchor and the outer surface of the limb and configured to adjust rotation of the outer surface of the limb around the longitudinal axis of the limb.

2. The archery bow assembly of claim 1, wherein the proximal end of the limb is a limb pivot surface.

3. The archery bow assembly of claim 1, wherein the anchor is a weight-tiller adjustment bolt.

4. The archery bow assembly of claim 1, wherein the anchor is a limb bolt and the outer surface of the limb comprises an adjacent surface positioned adjacent to the limb bolt, wherein the adjustable separator separates the adjacent surface from the limb-facing surface of the anchor.

5. The archery bow assembly of claim 1, wherein the adjustable separator is adjustably retained in the limb, and wherein the adjustable separator spreads apart the limb-facing surface of the anchor and the outer surface of the limb by adjustably extending from the outer surface of the limb.

6. The archery bow assembly of claim 1, wherein the adjustable separator is adjustably retained in the anchor, and wherein the adjustable separator spreads apart the limb-facing surface of the anchor and the outer surface of the limb by adjustably extending from the limb-facing surface of the anchor.

7. The archery bow assembly of claim 1, wherein the adjustable separator is adjustable by driving a threaded surface of the adjustable separator.

8. The archery bow assembly of claim 1, wherein the limb comprises a central longitudinal axis; wherein the at least one adjustable separator separates the anchor and the limb along an axis perpendicular to the central longitudinal axis of the limb.

9. The archery bow assembly of claim 1, wherein the at least one adjustable separator comprises at least two adjustable separators, wherein each of the at least two adjustable separators are positioned on opposing sides of the anchor.

10. The archery bow assembly of claim 1, wherein the at least one adjustable separator comprises a shim removably attachable between the limb-facing surface of the anchor and the outer surface of the limb.

11. The archery bow assembly of claim 10, wherein the shim is retained by a shaft.

12. The archery bow assembly of claim 1, wherein the at least one adjustable separator is partially insertable into at least one opening in the outer surface or riser-facing surface of the limb.

13. An archery bow assembly having adjustable limb placement, the bow assembly comprising:

a riser having a limb attachment portion, the limb attachment portion having a limb-facing surface;

a limb having a distal end extending away from the riser and a proximal end retained at the limb attachment portion of the riser, the limb having a riser-facing surface, an outer surface, and a longitudinal axis;

a dovetail bolt at least partially extending through the limb-facing surface of the limb attachment portion and the riser-facing surface of the limb, the dovetail bolt retaining the limb to the riser;

at least one adjustable separator positioned lateral to the dovetail bolt between the limb-facing surface of the limb attachment portion and the riser-facing surface of the limb, the at least one adjustable separator being configured to spread apart the limb-facing surface of the limb attachment portion and the riser-facing surface of the limb and configured to adjust a rotated position of the limb relative to the longitudinal axis of the limb.

14. The archery bow assembly of claim 13, wherein the adjustable separator comprises a threaded bolt.

15. The archery bow assembly of claim 13, wherein the adjustable separator comprises a removable shim.

16. An archery bow assembly having adjustable limb placement, the bow assembly comprising:

a riser having a limb attachment portion, the limb attachment portion having a limb-facing surface;

a limb having a distal end extending away from the riser and a proximal end retained at the limb attachment portion of the riser by an anchor, the limb having a riser-facing surface, an outer surface, and a longitudinal axis;

a dowel positioned between the limb-facing surface of the limb attachment portion and the riser-facing surface of the limb, the dowel positioned between the anchor and the distal end of the limb, the dowel comprising a limb-facing surface and at least one adjustable separator extending from the limb-facing surface, the adjustable separator contacting the riser-facing surface of the limb, wherein the adjustable separator is configured to adjustably separate the limb-facing surface of the limb attachment portion from the riser-facing surface of the limb and rotate the riser-facing surface of the limb about the longitudinal axis of the limb.

17. The archery bow assembly of claim 16, wherein the adjustable separator comprises a threading, wherein turning the adjustable separator drives the threading to extend or retract the adjustable separator from the limb-facing surface of the dowel.

18. The archery bow assembly of claim 16, wherein the adjustable separator comprises at least one shim positioned between the limb-facing surface of the dowel and the riser-facing surface of the limb.

19. The archery bow assembly of claim 18, wherein the shim is removably attached to the dowel.

20. The archery bow assembly of claim 18, wherein the adjustable separator further comprises at least one cover plate positioned between the shim and the riser-facing surface of the limb.

21. The archery bow assembly of claim 20, wherein the cover plate has a curved surface facing the limb.

22. The archery bow assembly of claim 16, wherein the adjustable separator is removably attached to the dowel.

23. The archery bow assembly of claim 16, wherein the dowel comprises at least two adjustable separators each being configured to contact the riser-facing surface of the limb.

24. An adjustable dowel for an archery bow, the dowel comprising:

a body portion having a first end and a second end, the body portion having a limb-facing surface and a riser-facing surface extending between the first end and the second end, wherein the body portion is configured to be movable in a lateral direction relative to a longitudinal axis of a limb upon attachment of the body portion and the limb to a bow riser;

an adjustable separator positioned on the limb-facing surface of the body portion, the adjustable separator extending from the limb-facing surface to a height, the adjustable separator being configured to change the height upon adjustment, the height being configured to correspond to a rotated position of a limb relative to the longitudinal axis when the limb is in contact with the adjustable separator.

25. The adjustable dowel of claim 24, wherein the height of the adjustable separator is continuously adjustable.

26. The adjustable dowel of claim 24, wherein the adjustable separator comprises a threaded post, the threaded post being adjustable by turning the threaded post relative to the body portion, thereby changing the height of the adjustable separator.

27. The adjustable dowel of claim 26, further comprising at least one set screw, the set screw preventing adjustment of the height upon tightening of the set screw against the threaded post.

28. The adjustable dowel of claim 24, wherein the height of the adjustable separator is incrementally adjustable.

29. The adjustable dowel of claim 28, wherein the adjustable separator comprises at least one shim removably attached to the limb-facing surface of the body portion.

* * * * *